US008011512B2

(12) United States Patent
Brollier et al.

(10) Patent No.: US 8,011,512 B2
(45) Date of Patent: Sep. 6, 2011

(54) CHILD-RESISTANT PACKAGE WITH LATCH AND RETAINING FEATURE

(75) Inventors: Brian W. Brollier, Cincinnati, OH (US); David Boase, Yorktown, VA (US)

(73) Assignee: International Paper Co., Memphis, TN (US)

( * ) Notice: Subject to any disclaimer, the term of this patent is extended or adjusted under 35 U.S.C. 154(b) by 214 days.

(21) Appl. No.: 12/356,831

(22) Filed: Jan. 21, 2009

(65) Prior Publication Data

US 2009/0184023 A1 Jul. 23, 2009

Related U.S. Application Data

(60) Provisional application No. 61/011,633, filed on Jan. 18, 2008.

(51) Int. Cl.
*B65D 83/04* (2006.01)

(52) U.S. Cl. ..... 206/531; 206/1.5; 206/532; 206/539; 229/125.125

(58) Field of Classification Search ..... 206/1.5, 206/528, 530, 531, 532, 534, 534.1, 534.2, 206/538, 539; 229/125.125
See application file for complete search history.

(56) References Cited

U.S. PATENT DOCUMENTS

| | | | | |
|---|---|---|---|---|
| 3,809,221 | A | 5/1974 | Compere | |
| 4,988,004 | A | 1/1991 | Intini | |
| 5,082,137 | A | 1/1992 | Weinstein | |
| 5,878,887 | A | 3/1999 | Parker et al. | |
| 6,047,829 | A | 4/2000 | Johnstone et al. | |
| 6,230,893 | B1 | 5/2001 | Karow | |
| 6,412,636 | B1 | 7/2002 | Jones et al. | |
| 6,460,693 | B1 | 10/2002 | Harrold | |
| 6,491,211 | B1 | 12/2002 | Evans et al. | |
| 6,641,031 | B2 | 11/2003 | Evans et al. | |
| 6,676,013 | B2 | 1/2004 | Auclair | |
| 6,752,272 | B2 | 6/2004 | Jones et al. | |
| 6,863,175 | B2 | 3/2005 | Gelardi | |
| 6,874,636 | B2 * | 4/2005 | Paliotta et al. | 206/531 |
| 7,090,079 | B2 | 8/2006 | Ehrlune | |
| 7,198,149 | B2 | 4/2007 | Gelardi | |
| 7,389,875 | B2 | 6/2008 | Sandberg et al. | |
| 7,475,784 | B2 | 1/2009 | Simon et al. | |
| 7,845,496 | B2 * | 12/2010 | Hession | 206/538 |

(Continued)

FOREIGN PATENT DOCUMENTS

| | | |
|---|---|---|
| WO | WO2005030606 | 4/2005 |

(Continued)

*Primary Examiner* — Luan K Bui
(74) *Attorney, Agent, or Firm* — Matthew M. Eslami; Dennis H. Lambert

(57) ABSTRACT

A child-resistant but adult-friendly package package comprising a sleeve having top and bottom walls, opposite side walls, a closed end, and an open end. A blister card insert configured to be movable into and out of the sleeve through the open end. A first latch element on the insert and a second latch element on the sleeve, the first and second latch elements are interengageable when the insert is fully inserted in the sleeve to latch the insert against withdrawal from the sleeve. A biasing member on the insert is configured to be in contact with the top and bottom walls of the sleeve, urging the first latch element into engagement with the second latch element. The biasing member also forming a first portion of a retaining means to prevent complete withdrawal of the insert from the sleeve and a second portion of the retaining means is formed on the sleeve for cooperation with the first portion to retain the insert against complete withdrawal from the sleeve.

21 Claims, 30 Drawing Sheets

U.S. PATENT DOCUMENTS

2003/0213721 A1* 11/2003 Jones ..... 206/528
2004/0182739 A1 9/2004 Williams-Hartman
2006/0144747 A1* 7/2006 Le et al. ..... 206/531
2006/0289328 A1 12/2006 Hession
2007/0045149 A1 3/2007 Hession
2007/0181458 A1 8/2007 Ehrlund
2009/0301924 A1* 12/2009 Rondeau ..... 206/531

FOREIGN PATENT DOCUMENTS

WO WO2005051801 6/2005
WO WO2007038771 4/2007
WO WO2007070487 6/2007

* cited by examiner

CHILD-RESISTANT PACKAGE WITH LATCH AND RETAINING FEATURE

This application is related to U.S. Provisional Patent Application Ser. No. 61/011,633, filed on Jan. 18, 2008.

FIELD OF THE INVENTION

This invention relates to child-resistant packaging. More particularly, the invention relates to a senior-friendly child-resistant package especially suited for containing multiple unit doses of medication. The child-resistant package comprises a blister card insert slidable into an outer box or sleeve, with latch means to prevent movement of the blister card insert out of the sleeve until the latch means is released, and retaining means to prevent complete separation of the blister card insert from the sleeve. The latch means requires separate, counter-intuitive operations to release it.

BACKGROUND OF THE INVENTION

Pharmaceuticals are typically packaged in containers that are difficult to open by a child but desirably easy to open by an adult. Many child resistant packages have been designed but they tend to also be difficult and cumbersome for an adult, especially a senior, to open.

Child resistant packages generally fall into one of three broad categories: vials or bottles with a child resistant cap or closure; blister packs with a removable barrier and/or a frangible push-through back; and pouches with tear-resistant material and concealed tear-notches. Exemplary of packaging with a removable barrier over a frangible back is that disclosed in U.S. Pat. No. 3,809,221, wherein a rupturable press-through blister type medicament or pill package is "childproofed" by securing a strong flexible polymeric backing sheet, such as polyethylene terephthalate, over the rupturable sheet in such a manner that the pill cannot be forced through the package unless the backing sheet is first peeled off Another example of this type of packaging is the so-called "bend-and-peel" structure disclosed in U.S. Pat. No. 4,988,004. While these packages are child resistant, they can also be difficult to open by a senior.

Requirements for senior-friendly packaging have been added to the regulations. A package is considered to be senior-friendly if it can be opened by a test panel in the age group 50-70. This age group is more likely than other adults to have medications in the home, and certain packages such as "push-down-and-turn" or "squeeze-and-turn" caps, or a removable barrier over a frangible back, can be difficult to operate by a senior, and especially someone with an arthritic condition. This difficulty would probably result in disabling the child-resistant feature and ultimately defeating the intended purpose of the packaging.

Efforts have been made in the prior art to solve the foregoing problems by providing a pill package with child-resistant properties while retaining ease of opening by an adult. Examples of this type of packaging are disclosed in U.S. Pat. Nos. 6,047,829, 6,230,893 and 6,752,272. These packages comprise a slide card insert incorporating a blister pack carrying multiple unit doses of medication, wherein the card is movable out of an outer sleeve to gain access to the blister pack and the medication carried therein. In the '829 and '893 patents the card is retained in the sleeve by a catch or latch, and a button 30 is depressed to release the latch and permit the card to be slid out of the sleeve so that the medication can be dispensed from the blister pack. Folded extensions on the sleeve engage the card to prevent it from being completely withdrawn from the sleeve. Although these packages would be relatively easy for a senior to open, they may also be easy for a child to open since it would be necessary only to depress the button 30 to release the locking feature, whereby the card could be gripped through the aligned notches and withdrawn from the sleeve. The '272 patent purports to solve this problem by providing offset, asymmetrically placed notches that require asymmetric placement of the fingers to grip and withdraw the slide card. However, this differs from the normal mode of opening only in that the fingers have to be offset slightly when gripping the card. Folded extensions are also provided on the sleeve in the package described in this patent, to engage the card to prevent it from being completely withdrawn from the sleeve.

It would be advantageous to have a package that is reliably difficult for a child to open but relatively easy for an adult to open, that may be opened and closed many times without adversely affecting the integrity of the package, and that is simple and inexpensive to make.

SUMMARY OF THE INVENTION

The present invention comprises a child-resistant package that is reliably difficult for a child to open but relatively easy for an adult to open, that may be opened and closed many times without adversely affecting the integrity of the package, and that is simple and inexpensive to make.

The child-resistant package of the invention is particularly suited for dispensing unit doses of a medication, and comprises an internal blister card insert movable into and out of an outer box or sleeve. The insert incorporates a blister pack that can carry multiple unit doses of a medication. Interengaged latch means on the insert and sleeve prevents opening of the package until the latch is released by performing multiple but simple operations, and retaining means prevents complete withdrawal of the insert from the sleeve. In a preferred embodiment, release of the latch means requires a separate, counter-intuitive operation. Electronics may be incorporated in the package to monitor dispensing of product and/or to provide a signal when the package is left open and not re-closed after the medication has been dispensed. An example of a package incorporating suitable electronics is disclosed in applicant's commonly owned copending application Ser. No. 11/637,385, the disclosure of which is incorporated by reference in full herein.

More specifically, in a preferred embodiment the outer box or sleeve and the blister card insert are each made from folded paperboard. In a preferred embodiment, the insert includes first and second blister card units foldably joined together, with each unit incorporating a blister pack and one unit folded over onto the other unit in parallel relationship thereto so that the medicant-containing blisters lie between the two units. It should be understood, however, that the insert need not include two units folded onto one another but one of the units can be omitted if desired. One of the insert units is longer than the other so that it has a free end projecting beyond the free end of the other insert unit, and an opening is formed in the free end, with one side of the opening defining a first latch element. The free end of said one insert unit is reversely folded to form a biasing member and one portion of a retaining means, as described hereinafter.

The sleeve comprises top and bottom walls, opposite side walls, one end wall, and an open end. A second latch element is formed on one of the top and bottom walls of the sleeve, projecting into the interior of the sleeve. The blister card insert is slid into the sleeve through the open end, with that unit having the opening and first latch element lying adjacent the wall of the sleeve having the second latch element. As the insert approaches its fully inserted position in the sleeve the two latch elements interengage to prevent reverse movement of the insert and withdrawal from the sleeve. The biasing member on the folded free end of the insert engages a wall of the sleeve opposite the wall having the second latch element and urges the first latch element toward the second latch to prevent disengagement of the first and second latch elements by the simple act of pulling the insert from the extension. An extension on one of the top or bottom walls of the sleeve, at its open end, is reversely folded to project back into the sleeve to form a second portion of said retaining means for cooperation with said first portion on the insert to prevent complete removal of the insert from the sleeve.

To withdraw the blister card insert from the sleeve in a preferred embodiment of the invention, the user must first place his or her finger against the end of the insert exposed through the open end of the sleeve, and push the insert farther into the sleeve against the spring-like bias provided by the folded end of the insert acting against the closed end of the sleeve, so that the two latch parts move out of alignment. This is a counter-intuitive move that will defeat the efforts of a child to open the package. While the insert is held in this inwardly moved forward position, the user presses down on the folded end of the insert, against the biasing member defined by the folded end, and simultaneously pushes the insert rearwardly through the open end. The latch is now disengaged and the insert can be withdrawn through the open end of the sleeve.

In an alternate embodiment, the first and second latch elements are constructed so that the insert does not first have to be moved farther into the sleeve. It is necessary only to press down on the end of the insert to disengage the latch means so that the insert can be withdrawn from the sleeve.

In the preferred embodiment, the reversely folded extension on the sleeve engages the folded end on the insert to prevent complete withdrawal and separation of the insert from the sleeve.

In an alternate embodiment, the folded end on the insert engages in an opening in the sleeve to retain the insert against complete withdrawal from the sleeve.

With the insert withdrawn from the sleeve, the two insert units can be unfolded to access the blisters so that the user can press against a selected blister to force one of the unit doses through the backing of the blister pack. When the desired dispensing has been completed, the two units of the insert are again folded over onto each other and the insert again slid into the sleeve until the latch engages as discussed above. This process can be repeated as many times as desired or necessary without adversely affecting the integrity of the package.

Several variations of construction of the sleeve and latch are disclosed herein, and all have a folded panel on the insert that forms a biasing member to urge the first and second latch elements toward one another and that also forms part of a retaining means to prevent complete removal of the insert from the sleeve. Preferred embodiments require three separate operations, including a counter-intuitive operation, to release the latch.

If desired, a tear-resistant layer can be applied to some portion or all of the sleeve and/or blister card insert to prevent a child from tearing open the package and defeating the child-resistant features. Suitable tear-resistant layers and coatings are known in the art and any could be used, including that disclosed in applicant's commonly owned copending application Ser. No. 11/593,462, the disclosure of which is incorporated by reference in full herein.

In spite of the child-resistant features described above, if the user does not close the package after use, the medication is available as if it were in a simple blister pack without any child resistance. Accordingly, in addition to the child-resistant features described above, the package of the invention can incorporate electronics to sound an alert if the package is not closed within a designated period of time. The sounding of an alert would prompt and encourage the user to close the package and lessen the chances of the package being left open and therefore not child-resistant.

The electronics could also monitor the dispensing of product from the package. An example of a package incorporating suitable electronics for monitoring dispensing of product is disclosed in the attached drawings and in applicant's commonly owned copending application Ser. No. 11/637,385, the disclosure of which is incorporated by reference in full herein. For providing an alert that the package is open, the circuit and software described in that application would be appropriately configured to accept a signal which would activate a timing cycle. At the end of the designated time an alert would sound. Closing the package would silence the alert and reset the timing cycle. The signal to tell the circuit that the package is closed or open could be from a simple membrane switch in the folded blister card insert that is depressed by pressure from the inside surface of the box. Other methods could be used, such as printing contacts on the insert and on the inside of the sleeve, or providing a light sensor that would be exposed to light when the insert is withdrawn from the sleeve, or other methods know to those skilled in the art.

A package with the child resistant features described above and only the open package alert could be designed to provide a scaled down and thus lower cost version. This simplified alert could be built into the blister card insert or into the sleeve.

Advantages of this invention are that it is easy for an adult/senior to open the package but not intuitive for a young child. The package of the invention also does not require bending in the process of opening, thereby lending itself to being used with electronically enabled blister packs in that the electrical traces would not be subjected to extreme bending forces that could cause them to be damaged or broken. Also, the pills are not visible when the package is closed. This is an added deterrent to a child in that the pills do not attract their attention as readily. Further, an electronic alert in the package which would sound when the package is left open and not re-closed after taking the medication would help assure that the child-resistant features are always enabled.

Accordingly, one aspect of the present invention relates to a child-resistant but adult-friendly package comprising a sleeve having top and bottom walls, opposite side walls, a closed end, and an open end. A blister card insert configured to be movable into and out of the sleeve through the open end. A first latch element on the insert and a second latch element on the sleeve, the first and second latch elements are interengageable when the insert is fully inserted in the sleeve to latch the insert against withdrawal from the sleeve. A biasing member on the insert is configured to be in contact with the top and bottom walls of the sleeve, urging the first latch element into engagement with the second latch element. The biasing member also forming a first portion of a retaining means to prevent complete withdrawal of the insert from the sleeve and a second portion of the retaining means is formed on the sleeve for cooperation with the first portion to retain the insert against complete withdrawal from the sleeve.

Another aspect of the present invention relates to a child-resistant package comprising a sleeve having top and bottom walls, opposite side walls, a closed end, and an open end. A blister card insert movable into and out of the sleeve through the open end. A first latch element on the insert and a second latch element on the sleeve, the first and second latch elements are interengageable when the insert is fully inserted in the sleeve to latch the insert against withdrawal from the sleeve. Biasing means is operatively connected with the insert to urge the insert in a direction toward the open end of the sleeve and to urge the first latch element into engagement with the second latch element. And release means operable to disengage the first and second latch elements to permit withdrawal of the insert from the sleeve, the release means is ineffective to disengage the first and second latch elements until the insert is moved farther into the sleeve against the biasing means.

A further aspect of the present invention relates to a blank for making a sleeve of a child-resistant package that has a sleeve with top and bottom walls, opposite side walls, a closed end, and an open end, and a blister card insert movable into and out of the sleeve through the open end. The blank comprises two major panels disposed in spaced side-by-side relationship and those form the top and bottom walls, respectively, of a sleeve erected from the blank. A first minor panel is connected between adjacent side edges of the major panels and that forms one sidewall of a sleeve erected from the blank and second and third minor panels on opposite outer side edges of the respective major panels and that together form a second sidewall of a sleeve erected from the blank. A first flap is foldably joined to a first end of one of the major panels, and a second flap is foldably joined to an end of the other major panel that is adjacent the first flap. The first and second flaps are overlapped and glued together in a sleeve erected from the blank to form one end wall. The latch panel is foldably joined to a second end of the one major panel opposite the first end, the latch panel having a free end and a narrow latch tab projecting from the free end. An extension panel is joined to the end of the other major panel opposite the end to which the second flap is attached and a first line of perforations in a midportion of the first flap and in an adjacent portion of the one major panel. The first line of perforations defines a first tear-out panel, and a second line of perforations in a midportion of the second flap. The second line of perforations defines a second tear-out panel, the first and second tear-out panels overlying one another and being removed together to form a finger access opening in a sleeve erected from the blank.

A yet another aspect of the present invention relates to a blank for making an insert of a child-resistant package that has a sleeve with top and bottom walls, opposite side walls, a closed end, and an open end, and a blister card insert movable into and out of the sleeve through the open end. The blank comprises a paperboard substrate comprising a first panel with a plurality of openings therethrough for receiving raised blister cavities of a blister pack when a blister pack is attached to the first panel. A second panel is foldably connected to one side edge of the first panel. A plurality of score lines in the second panel defining punch-out areas that are in aligned registry with the openings in the first panel when the first and second panels are folded into overlying relationship with one another. A first end of each of the first and second panels are elongated with spaced apart parallel fold creases extending transversely across the elongated ends, defining two foldable panels on the elongated ends of each of the first and second panels, the foldable panels defining a biasing member and retaining means in a package erected from the blank. Openings in the first and second panels, respectively, are in positions to be in aligned registry with one another when the panels are folded into overlying relationship with one another. One edge of each opening is shaped to define a latch tab protruding into the opening from a side thereof, the latch tab comprising a first latch element for cooperation with a second latch element on a sleeve in a package erected from the blank. A third panel is foldably connected by a hinge panel to a second end of the first panel opposite the first end, and a fourth panel is foldably connected to a side edge of the third panel and also is foldably connected by a hinge panel to a second end of the second panel. The third panel is constructed substantially identically to the first panel and the fourth panel is constructed substantially identically to the second panel, except that the third and fourth panels are shorter in length than the first and second panels.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAIL DESCRIPTION OF THE INVENTION

First Embodiment

Figure 1:
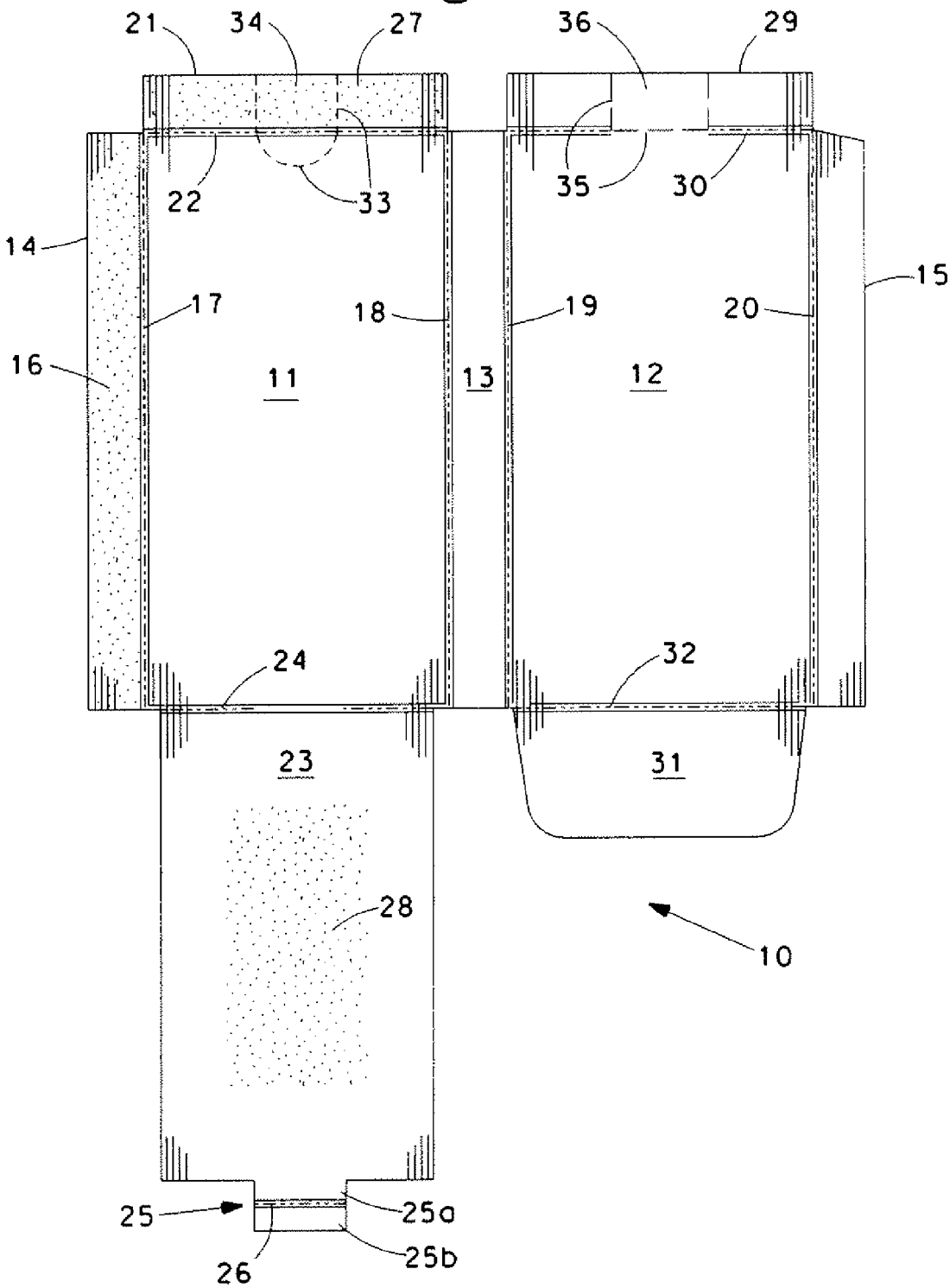
FIG. 1 is a plan view of a blank for making the sleeve of a first and preferred embodiment of the package of the invention.

A blank for making a first embodiment of sleeve for use in the package of the invention is indicated generally at 10 in FIG. 1. This view is looking at the surface of the blank that is the interior in a sleeve erected from the blank. The blank comprises two major panels 11 and 12 that form the top and bottom walls of a sleeve erected from the blank, a first minor panel 13 connected between adjacent side edges of the major panels and that forms one sidewall of a sleeve erected from the blank, and second and third minor panels 14 and 15 on opposite side edges of the respective major panels. Adhesive 16 is applied to the surface of at least one of the minor panels 14 or 15 (shown applied to the panel 14 in the example illustrated), and in a sleeve erected from the blank the panels 14 and 15 are overlapped and glued together to form a second sidewall of the sleeve. The minor panels are joined to the major panels along parallel creased fold lines 17, 18, 19 and 20.

A first flap 21 is foldably joined to one end of the major panel 11 along a creased fold line 22, and a latch panel 23 of slightly smaller dimensions than the panel 11 is foldably joined along a creased fold line 24 to the end of the panel 11 opposite the flap 21. A narrow latch tab 25 projects from the free end of the latch panel, and a creased fold line 26 extends across the width of the tab at approximately its midportion, dividing the tab into first and second portions 25*a* and 25*b*. Adhesive 27 is applied to the flap 21, and adhesive 28 is applied to a midportion of the latch panel, extending over most of the area of the panel but spaced from opposite side and end edges thereof.

A second flap 29 is foldably joined along a creased fold line 30 to that end of the major panel 12 that is adjacent the first flap, and the first and second flaps 21 and 29 are overlapped and glued together in a sleeve erected from the blank to form one end wall. An extension panel 31 is joined along a creased fold line 32 to the end of the major panel 12 opposite the end to which the second flap is attached.

A first line of perforations 33 define a first tear-out panel 34 in a midportion of the first flap 21 and an adjacent portion of the major panel 11, and a second line of perforations 35 define a second tear-out panel 36 in a midportion of the second flap 29. In a sleeve erected from the blank, the first and second tear-out panels overlie one another and are removed together to form a finger access opening as described hereinafter.

Figure 2:
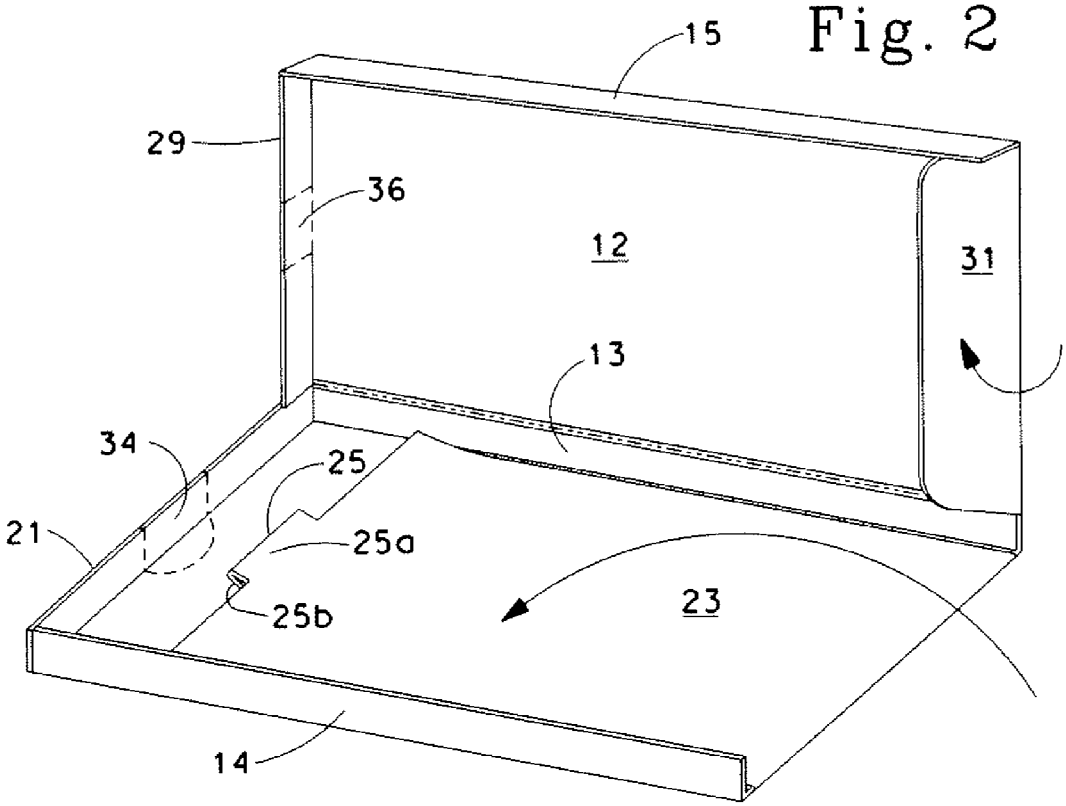
FIG. 2 is a top perspective view of the sleeve partially erected from the blank of FIG. 1.
Figure 3:
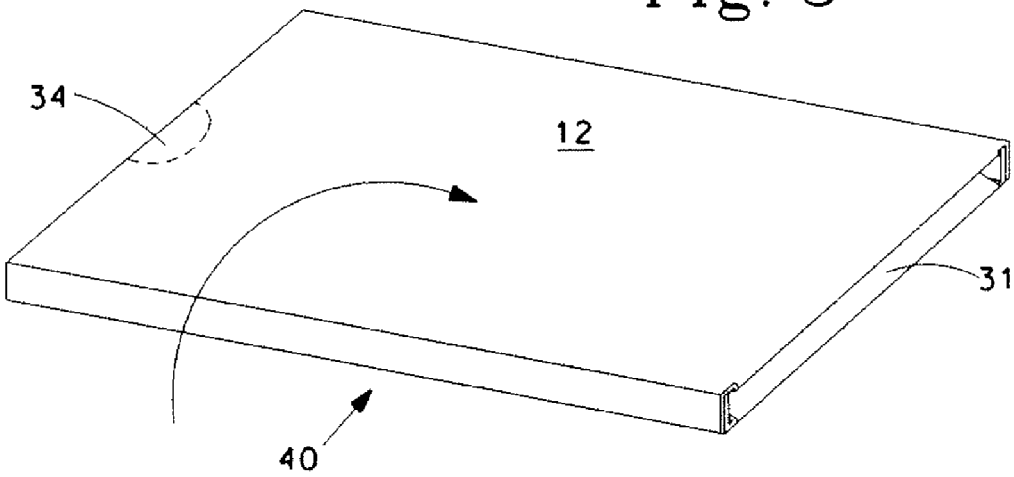
FIG. 3 is a top perspective view of a fully erected sleeve according to the first embodiment of the invention.

FIGS. 2 and 3 depict the manner of folding and gluing the blank to form a sleeve 40 according to the invention. Thus, as seen in FIG. 2 the minor panels 14 and 15 and first and second flaps 21 and 29 are folded upwardly generally perpendicular to the major panels, the tab 25 on latch panel 23 is folded about fold line 26, with the free end portion 25*b* folded under the portion 25*a*. The latch panel is then folded inwardly and glued to the major panel 11, with the folded end 25*b* of the tab lying under the end of the latch panel. The memory of the folded tab causes it to bias the end of the latch panel away from the major panel to which it is glued, as depicted in FIG. 2. The extension panel 31 is folded inwardly, and the major panels are then folded into overlying relationship with one another, the flaps 21 and 29 glued together, and the minor panels 14 and 15 glued together to form the completed sleeve 40 as depicted in FIG. 3.

The tab 25 defines a second latch element or catch that cooperates with a first latch element on the blister card insert to prevent it from being withdrawn from the sleeve, as described hereinafter, and the extension panel 31 defines a first portion of a retaining means that prevents complete removal of the insert from the sleeve, also as described hereinafter.

Figure 4:
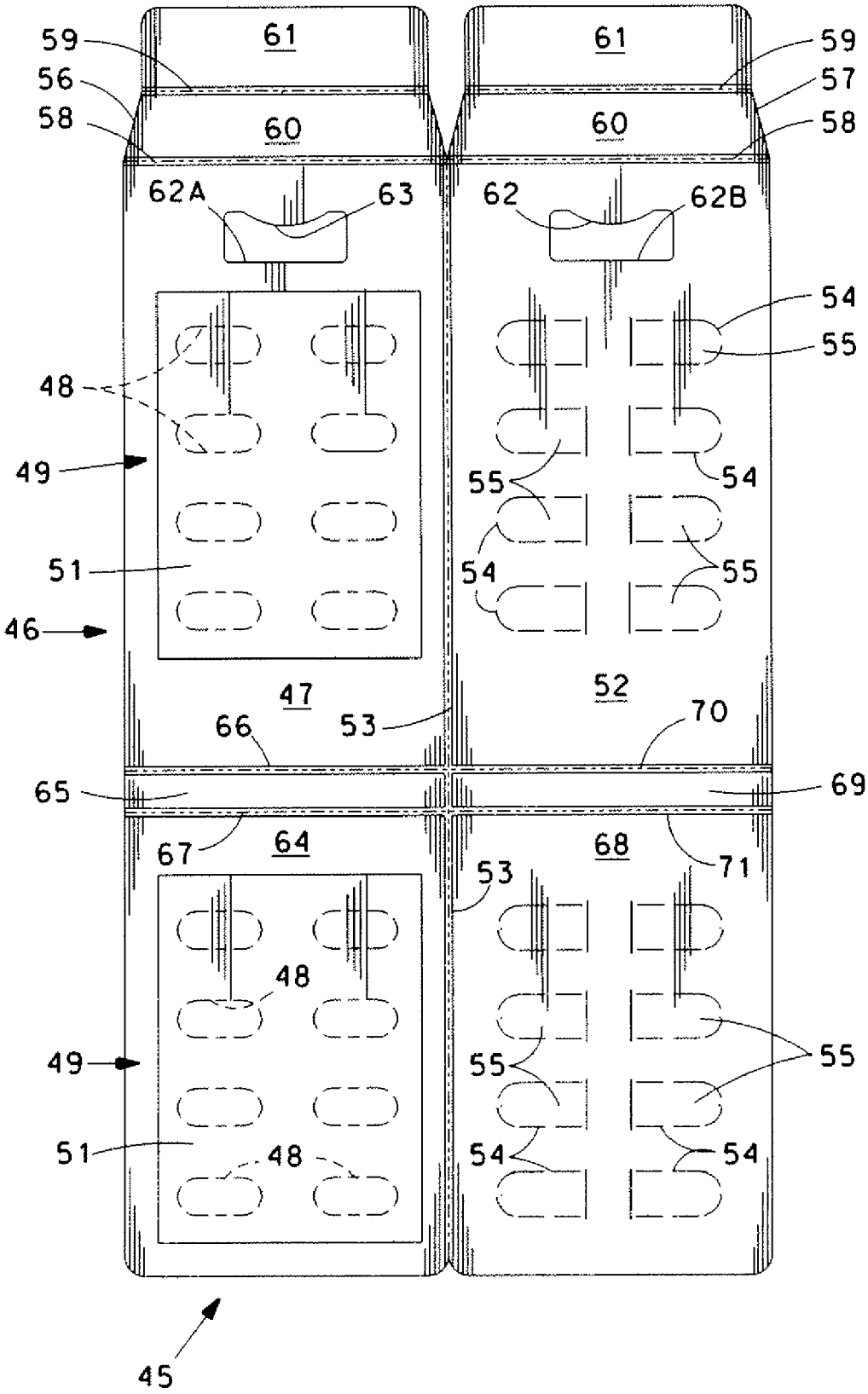
FIG. 4 is a plan view of a blank for making a blister card insert for use in the package according to the invention.

A blank 45 for making a first embodiment of blister card insert according to the invention is shown in FIG. 4. The card comprises a paperboard substrate 46 having a first panel 47 with a plurality of openings 48 therethrough. A blister pack 49 having a plurality of raised blister cavities 50 projecting therefrom is adhesively attached to the side of the panel 47 facing upwardly in FIG. 4, with the raised blisters 50 (see FIG. 5) projecting downwardly through the openings 48. The blister pack includes a sheet of foil or other frangible material 51 adhesively attached to close the blisters and retain pills or other objects in the blisters until they are dispensed by pushing against the blisters and forcing the pills through the foil or other material.

Figure 5:
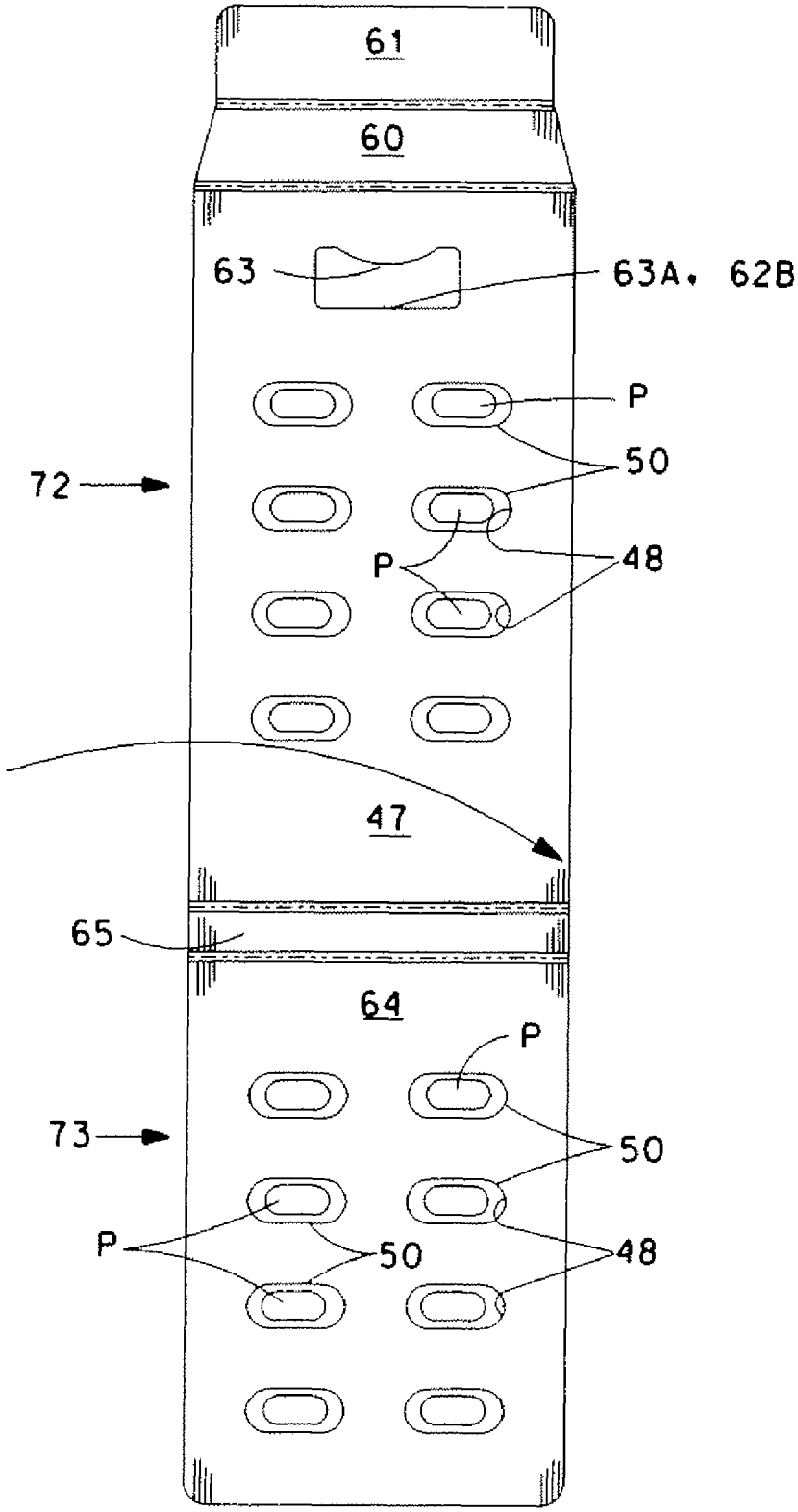
FIG. 5 is a plan view of a partially folded blister card insert according to the invention, made from the blank of FIG. 4.

A second panel 52 is foldably connected to one side edge of panel 47 along a creased fold line 53, and has a plurality of score lines 54 defining punch-out areas 55 that are in aligned registry with the openings 48 and blisters 50 when panels 47 and 52 are folded into overlying relationship as depicted in FIG. 5. The panel 52 comprises a reinforcing backing to the blister pack that increases the child resistance of the package by making it harder to push the pills or capsules or the like out of the blisters, but this panel and its attendant feature could be omitted if desired.

A first end of each of the panels 47 and 52 is elongated at 56 and 57, respectively, and spaced apart parallel fold creases 58 and 59 extend transversely across the elongated ends, defining two foldable panels 60 and 61 on the elongated first ends of each of the panels 47 and 52. These foldable panels define a biasing member and retaining means as described hereinafter. Openings 62A and 62B are formed in the panels 47 and 52, respectively, between the respective fold creases 58 and respective adjacent openings 48 and punch-out areas 55, in positions to be in aligned registry with one another when the panels 47 and 52 are folded into overlying relationship with one another as described later. One edge of each opening 62A and 62B is shaped to define a latch tab 63 protruding into the opening from the side of the opening adjacent fold crease 58. The latch tab comprises a first latch element for cooperation with the second latch element on the sleeve as described above.

A third panel 64 is foldably connected to a second end of panel 47 opposite the first end by a hinge panel 65 defined by a pair of spaced fold creases 66 and 67, and a fourth panel 68 is foldably connected to the side edge of panel 64 by a continuation of fold crease 53 and to a second end of panel 52 by a hinge panel 69 defined by a pair of spaced fold creases 70 and 71. The third panel 64 is constructed substantially identically to panel 47, and the fourth panel 68 is constructed substantially identically to panel 52, except that they are shorter in length than panels 47 and 52. Accordingly, the same reference characters as used in connection with the components of panels 47 and 52 are applied to the components of panels 64 and 68, respectively, but panels 64 and 68 will not be described in detail, it being understood that the same description applies generally to the corresponding panels.

To erect the blister card, the panels 47 and 64 are folded along fold line 53 so that the sides of the panels on which the blister packs are attached lie against the respective panels 64 and 68, as depicted in FIG. 5, and the overlying panels are glued to one another to form first and second blister card units 72 and 73.

Figure 6:
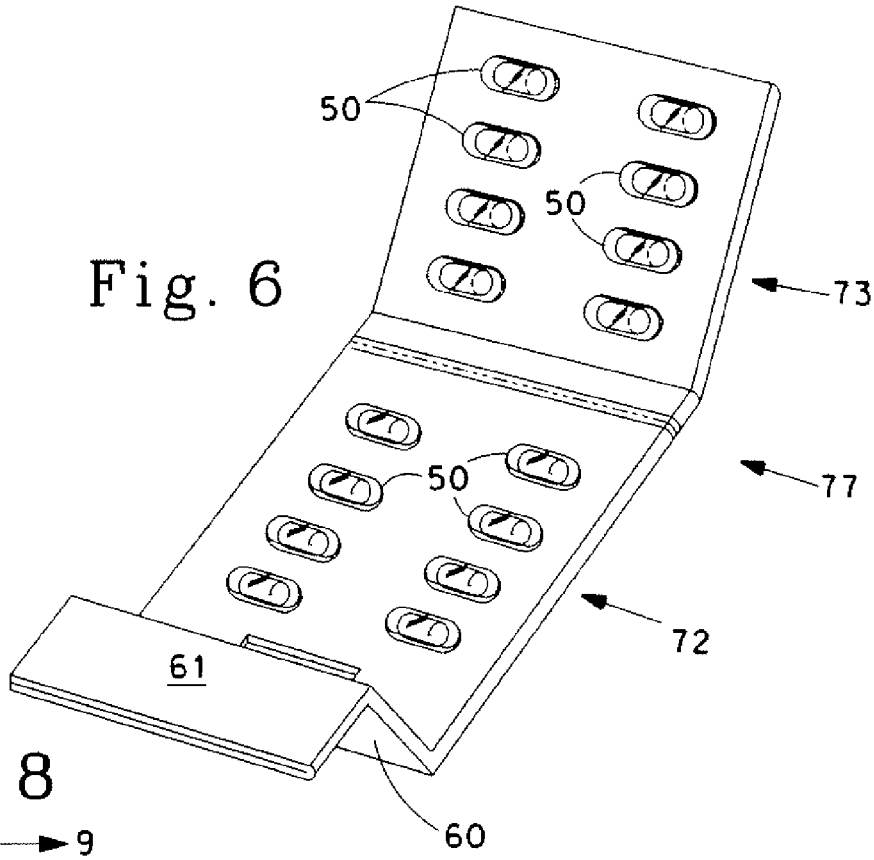
FIG. 6 is a perspective view of a further partially folded blank to make a blister card insert according to the invention.
Figure 7:
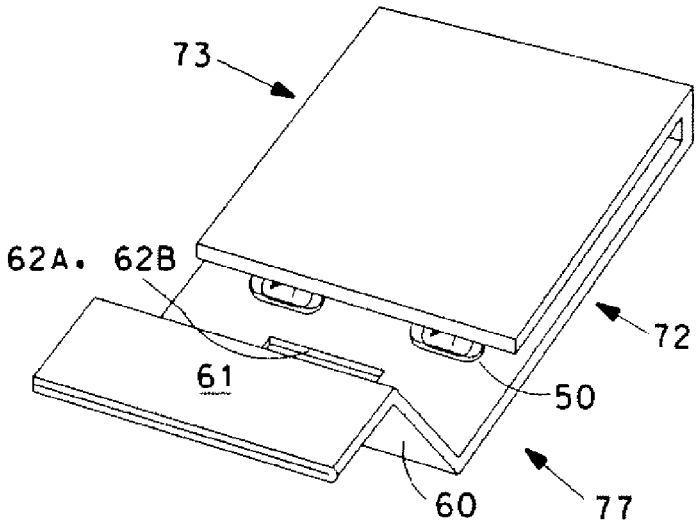
FIG. 7 is a perspective view of a fully erected blister card insert according to the invention.

The foldable panels 60 and 61 are then folded into a Z-shape and the blister card units 72 and 73 are folded onto one another with the blisters in confronting nested relationship, as depicted in FIGS. 6 and 7, to form the blister card insert 77 as used in the invention (see FIGS. 6 and 7).

Figure 9:
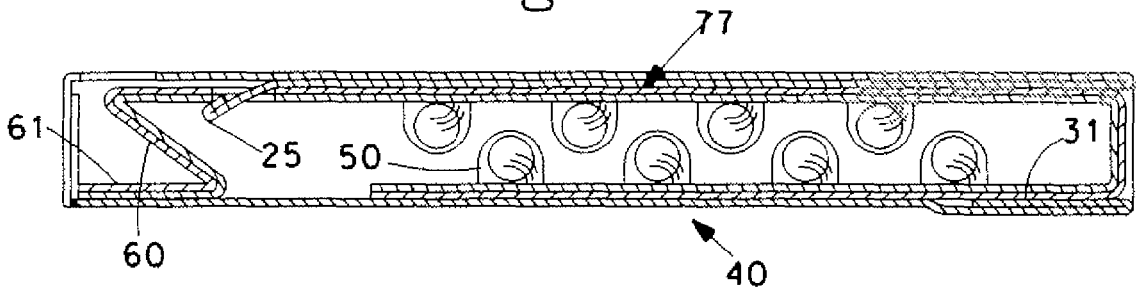
FIG. 9 is a longitudinal sectional view of the package, taken along line 9-9 in FIG. 8, showing the blister card insert in its fully inserted latched position in the sleeve.

The blister card insert 77 is then inserted into the open end of the sleeve 40, with the Z-shaped fold leading and the blister card unit 73 containing the opening 62A, 62B and latch tab 63 (collectively the first latch element) lying adjacent the side of the sleeve that has the latch panel 23 and catch 25. The blister card insert is pushed forwardly against the yieldable bias imparted by the Z-shaped fold after it engages the end wall of the sleeve, so that the catch 25 (second latch element) drops into the opening 62A, 62B (first latch element). When pressure against the insert is released, the bias of the Z-shaped fold urges the insert rearwardly toward the open end of the sleeve and engages the latch tab 63 behind the catch 25, thereby latching the insert against reverse movement and withdrawal from the sleeve. (See FIG. 9).

Figure 8:
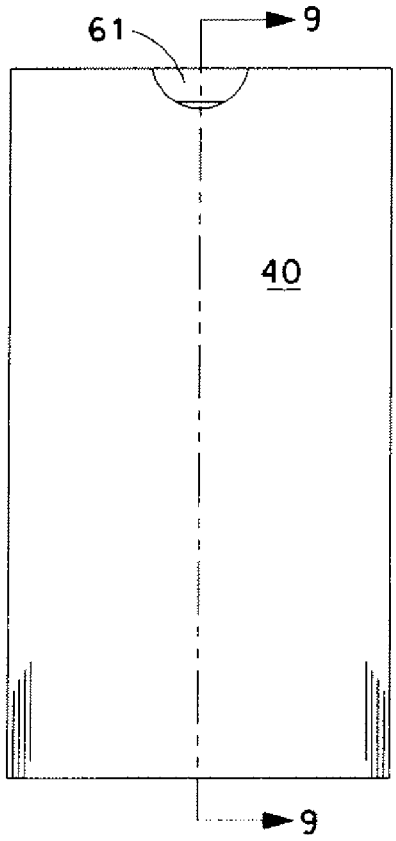
FIG. 8 is a plan view of a package according to the invention, with the blister card insert received in the sleeve and frangible portions removed to enable pressing against the insert to release the latch and initiate withdrawal of the insert from the sleeve.
Figure 10:
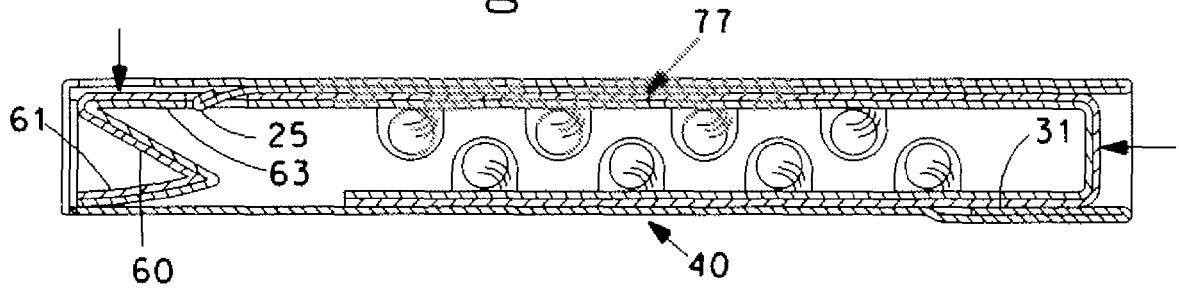
FIG. 10 is a longitudinal sectional view similar to FIG. 9, but showing the insert urged forwardly in the sleeve to disengage the latch.
Figure 11:
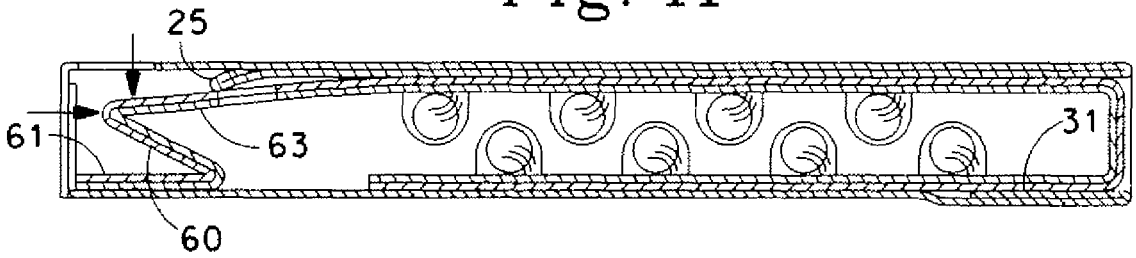
FIG. 11 is a longitudinal sectional view similar to FIG. 9, showing the insert being urged rearwardly while the latch is held out of alignment, to initiate withdrawal of the insert from the sleeve.

When a user desires to access the items in the blister pack, the tear out panels 34 and 36 are first removed, exposing an end portion of the insert adjacent the Z-shaped fold, as seen in FIG. 8. The insert must then be urged forwardly in the sleeve by exerting pressure against the insert hinge to overcome the bias of the Z-shaped fold, as depicted in FIG. 10. This is a counter-intuitive operation, since it moves the insert in a direction further into the sleeve, but is necessary in order to move the tab 63 from behind the catch 25. As shown in FIGS. 10 and 11, while the insert is held in this forward position, the user inserts his or her finger into the opening defined by removing the tear out panels, and presses down on the exposed end portion of the insert, thereby moving the tab 63 out of alignment with the catch 25. While continuing to hold the end of the insert downward, rearward pressure is exerted against the end of the insert to push it through the open end of the sleeve. It is necessary to move the insert only a short distance to move the tab 63 past the catch 25, and the rearward end of the insert may then be grasped to pull the insert out of the sleeve, as depicted in FIG. 12.

Figure 12:
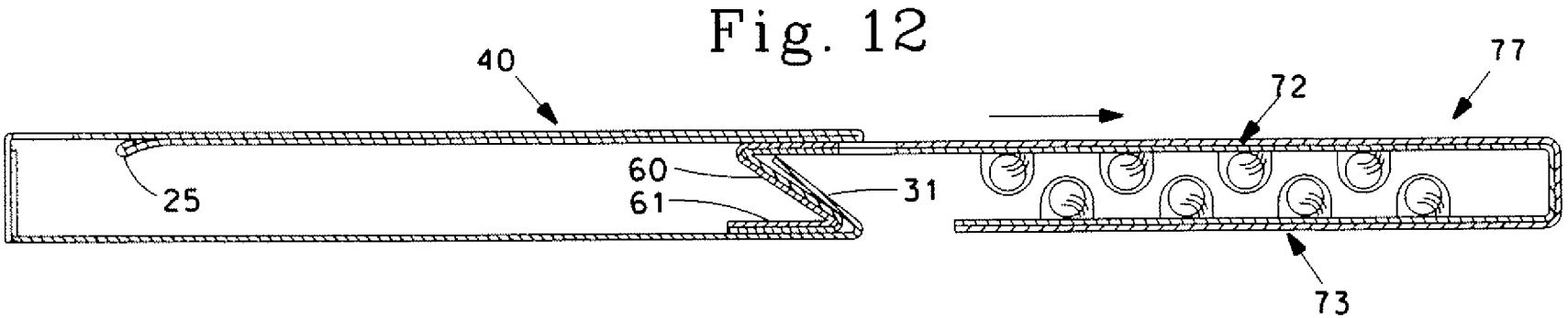
FIG. 12 is a longitudinal sectional view similar to FIG. 9, showing the blister card insert fully withdrawn from the sleeve until stopped by the retaining means, and prior to unfolding of the insert to gain access to the blisters for dispensing product.
Figure 13:
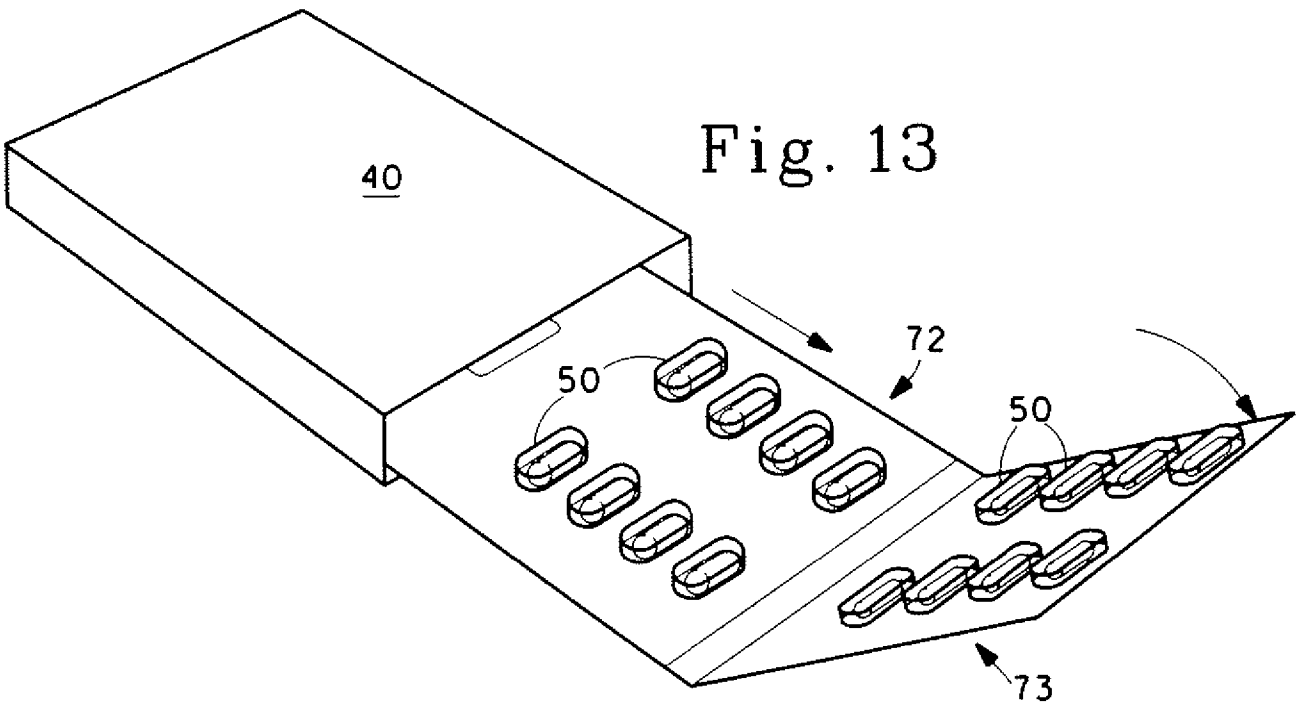
FIG. 13 is a perspective view of the package of the invention, with the blister card insert withdrawn from the sleeve and opened up ready for dispensing.

It will be noted in FIG. 12 that the Z-shaped fold now performs another function. When the insert has been fully withdrawn from the sleeve and the blister card unit 73 is clear of the open end of the sleeve so that the blister card units may be unfolded to gain access to the blisters to dispense product, as depicted in FIG. 13, the Z-shaped fold engages behind the inwardly folded extension panel 31 on the sleeve, retaining the blister card insert in the sleeve and preventing complete separation of the insert from the sleeve. During initial insertion of the insert into the open end of the sleeve, the extension panel 31 is forced downwardly, enabling the insert to slide over it. When the second card unit 73 clears the open end of the sleeve upon withdrawal of the insert from the sleeve, the extension panel springs upwardly in position to catch the Z-shaped fold.

After product has been dispensed, the card units are again folded into the position shown in FIG. 7 and the insert is reinserted into the sleeve until the tab 63 latches behind the catch 25.

As can be seen, multiple operations must be performed to release the latch holding the insert in the sleeve, and at least one of these operations is clearly counter-intuitive, thereby making the package reliably child resistant.

Second Embodiment

Figure 14:
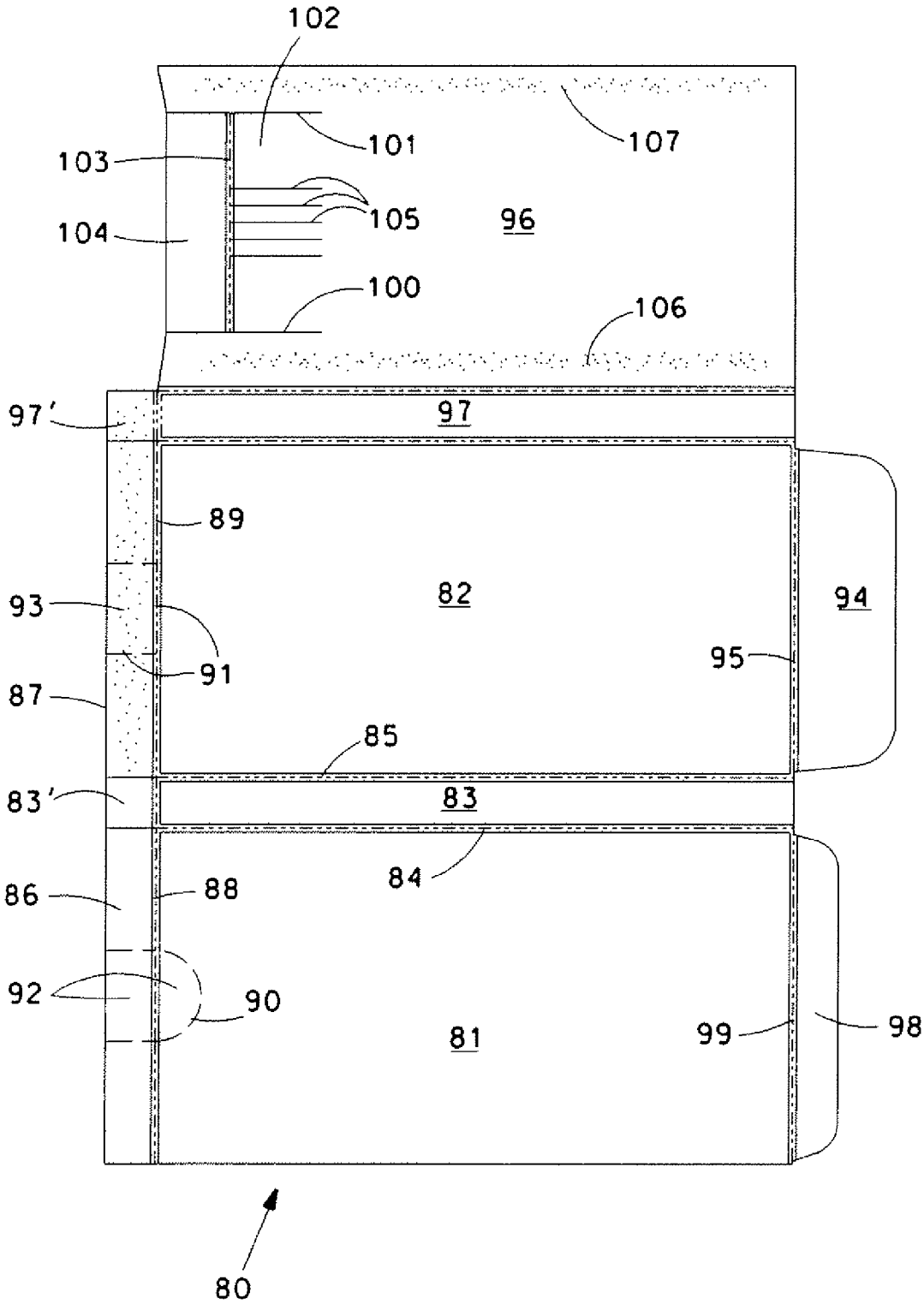
FIG. 14 is a plan view of a blank for making a sleeve according to a second embodiment of the invention.

A blank 80 for making a second embodiment of sleeve according to the invention is shown in FIG. 14. As in the first embodiment, the blank comprises two major panels 81 and 82 that form the top and bottom walls, respectively, of a sleeve erected from the blank, and a first minor panel 83 connected between adjacent side edges of the major panels along fold creases 84 and 85 to form one sidewall of a sleeve erected from the blank. End flaps 86 and 87 are foldably joined to adjacent ends of respective major panels 81 and 82 along fold creases 88 and 89, respectively, and in a sleeve erected from the blank these flaps are overlapped and glued together to form an end wall. Lines of perforations 90 and 91 in these flaps define tear out panels 92 and 93, and an extension panel 94 is foldably joined to the end of panel 82 along fold crease 95, all as in the previous embodiment.

This second embodiment of the invention differs from the previous embodiment in that there is no minor panel on the side edge of the major panel 81 opposite the edge connected to minor panel 83, and rather than being connected to an end of one of the major panels, the latch panel 96 is foldably connected to a second minor panel 97 on the side edge of major panel 82 opposite the edge connected to minor panel 83. The second minor panel 97 forms a second sidewall in a sleeve erected from the blank. Also, small rectangular tabs 83' and 97' are foldably connected to the ends of the minor panels 83 and 97, respectively, and a second extension flap 98 is foldably connected along a fold crease 99 to the end of major panel 81, where the latch panel was connected in the previous embodiment. Further, the catch on the latch panel is constructed differently than in the previous embodiment. In this second embodiment the catch is defined by a pair of spaced slits 100, 101 extending inwardly from one end of the latch panel, delineating a tab 102 extending over a center portion of one end of the latch panel. A fold crease 103 extends transversely across the width of the tab, spaced inwardly from the free end thereof, defining a foldable flap 104, and a plurality of reinforcing creases 105 are formed in the tab extending from the fold crease to approximately in line with the inner terminal ends of the slits 100, 101.

Figure 15:
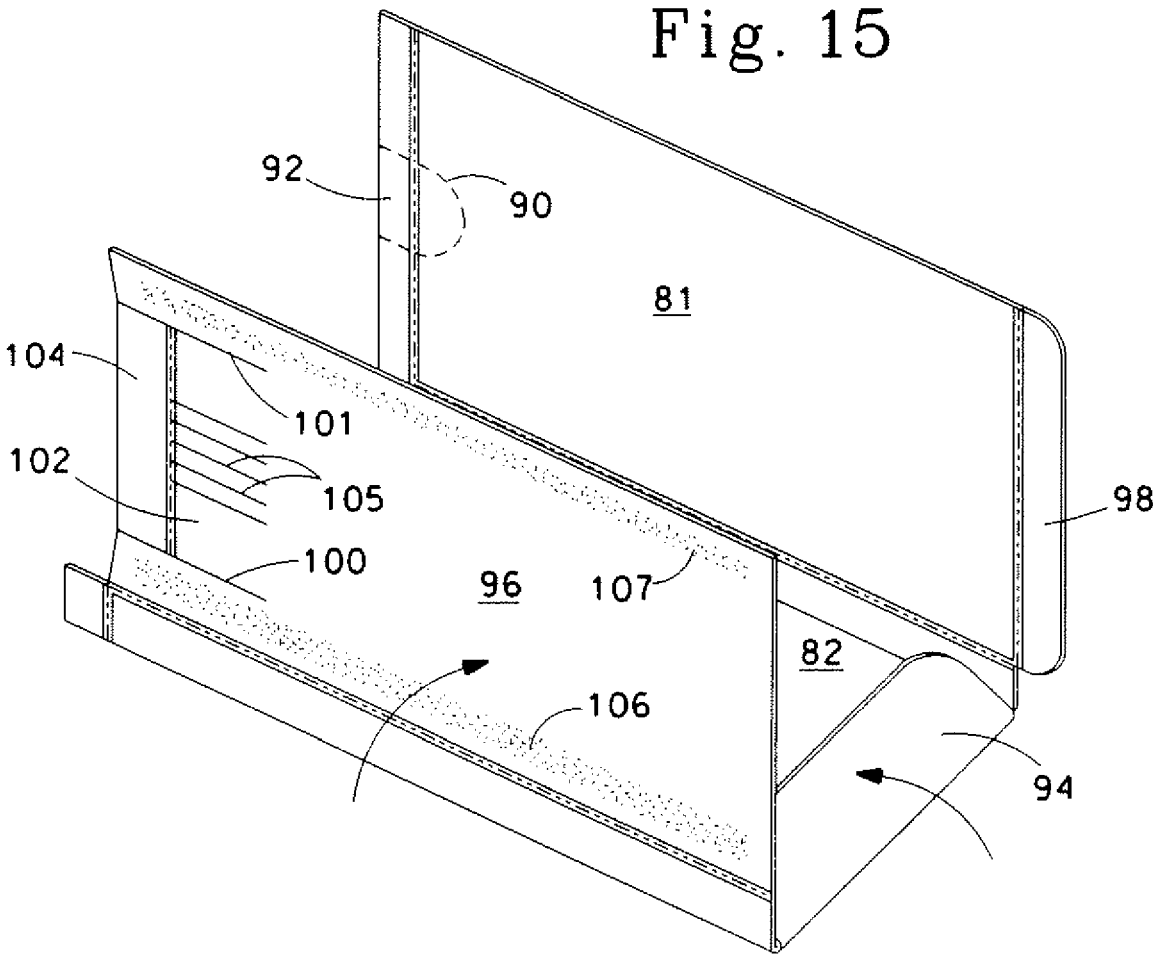
FIG. 15 is a perspective view of the second embodiment of sleeve partially erected from the blank of FIG. 14.
Figure 16:
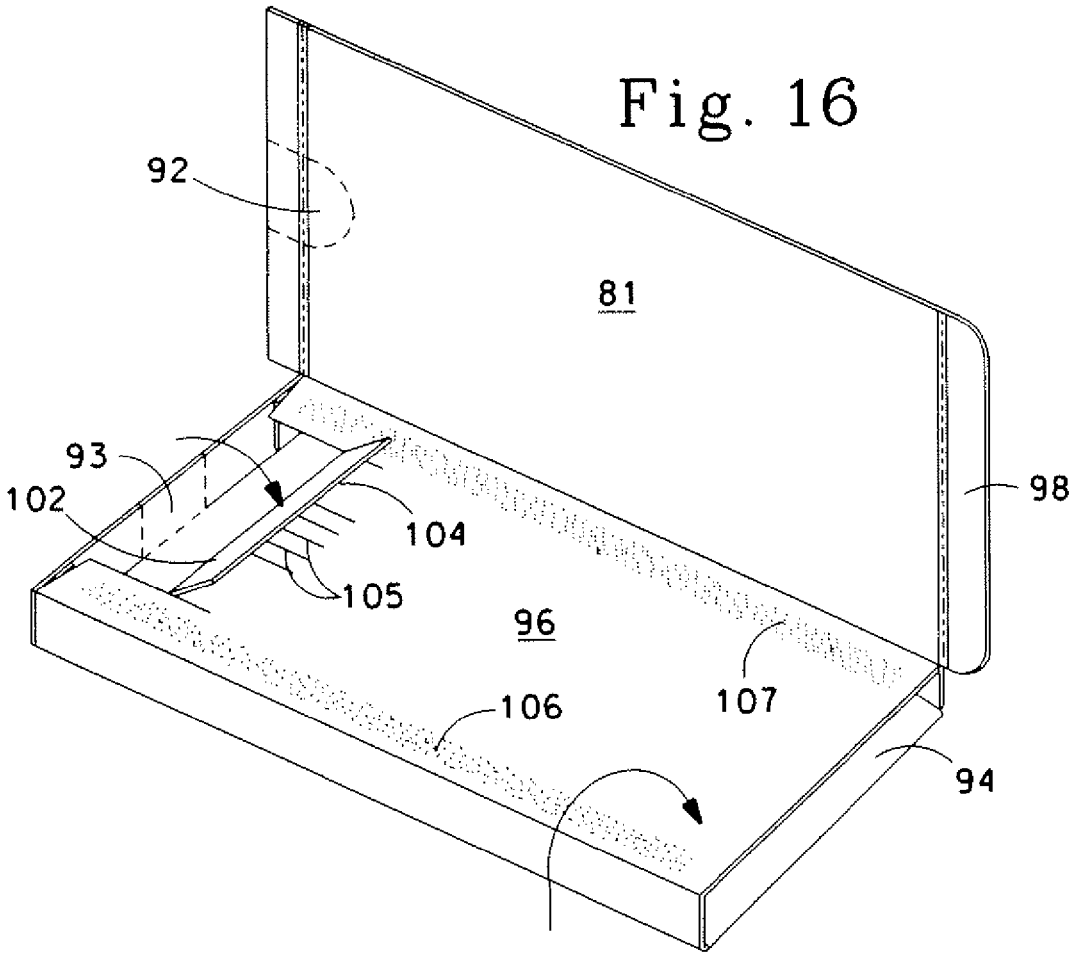
FIG. 16 is a perspective view of the container of FIG. 15 shown further partially folded to make the sleeve according to the second embodiment of the invention.
Figure 17:
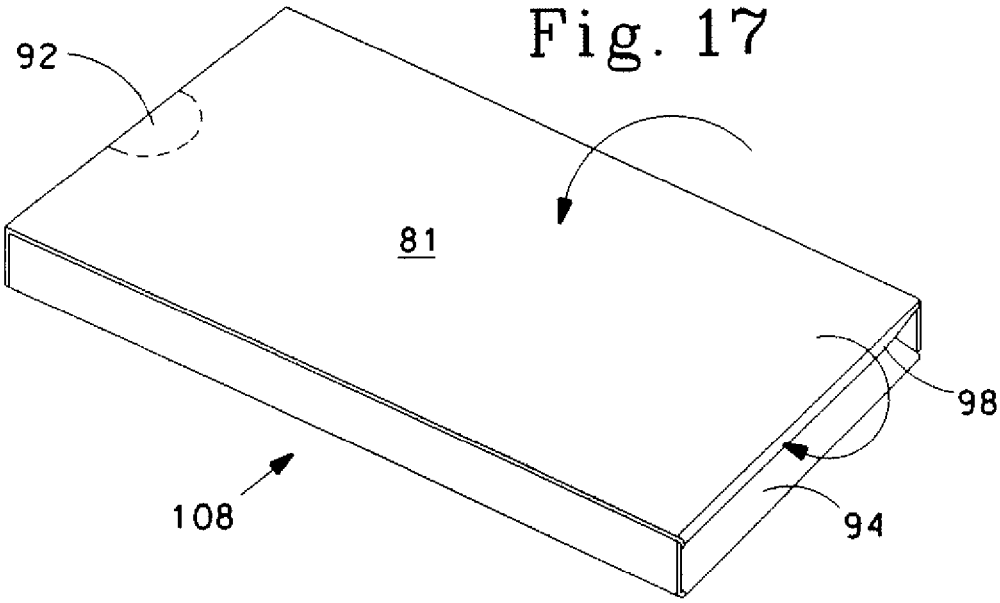
FIG. 17 is a perspective view of the fully erected sleeve according to the second embodiment of the invention.

To erect a sleeve from the blank of FIG. 14, the major panel 82 and latch panel 96 are folded in a direction into the plane of the paper as seen in FIG. 14, to the positions depicted in FIG. 15, with the minor panels 83 and 97 standing up perpendicular to the major panel 81, and the extension panel 94 folded inwardly. The tabs 83' and 97' are folded inwardly, the end flap 87 is folded upwardly, and the end flap 86 is folded down into overlapping relationship with end flap 87 and glued thereto. The latch panel 96 is folded inwardly into parallel, spaced relationship to the panel 87, with the foldable flap 104 folded rearwardly, as depicted in FIG. 16. The panel 86 is then folded over onto the latch panel and adhered thereto by bands of adhesive 106 and 107 along opposite side edges of the latch panel, with the extension flap 98 folded inwardly, to form the sleeve 108 according to the second embodiment of the invention, as depicted in FIG. 17.

The principle of operation of the second embodiment is the same as in the first embodiment, and the same blister card is used. The foldable flap 104 acts as a spring to bias the tab 102 toward the interior of the sleeve for cooperation with the tab 63 on the blister card 77 to latch it against withdrawal from the sleeve, as in the previous embodiment. Similarly, the extension panel 94 catches the Z-shaped fold on the card to prevent complete separation of the card from the sleeve. Flap 104 could be constructed to be narrower than the width shown.

Third Embodiment

Figure 18:
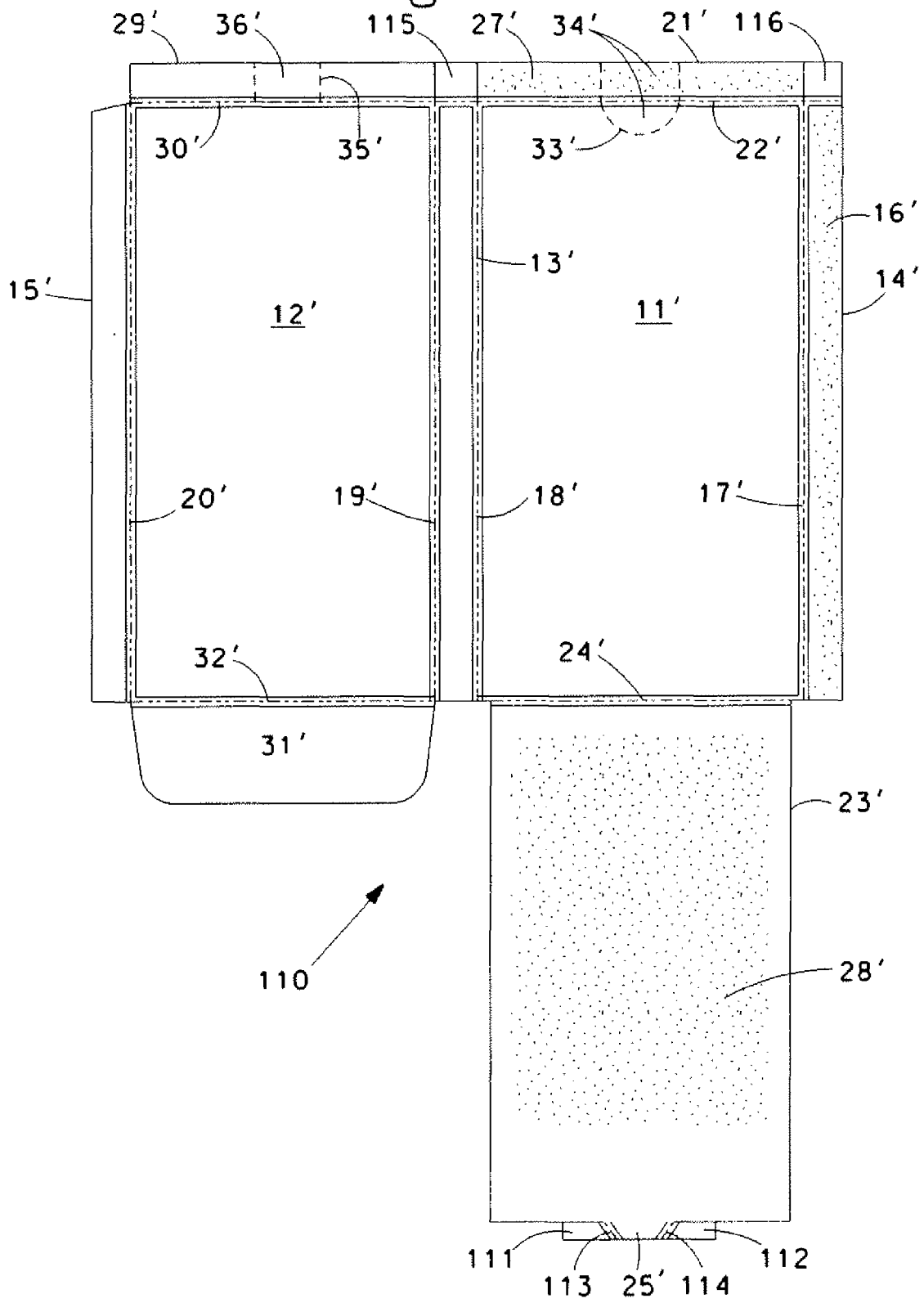
FIG. 18 is a perspective view of a blank for making a third embodiment of sleeve according to the invention.
Figure 19:
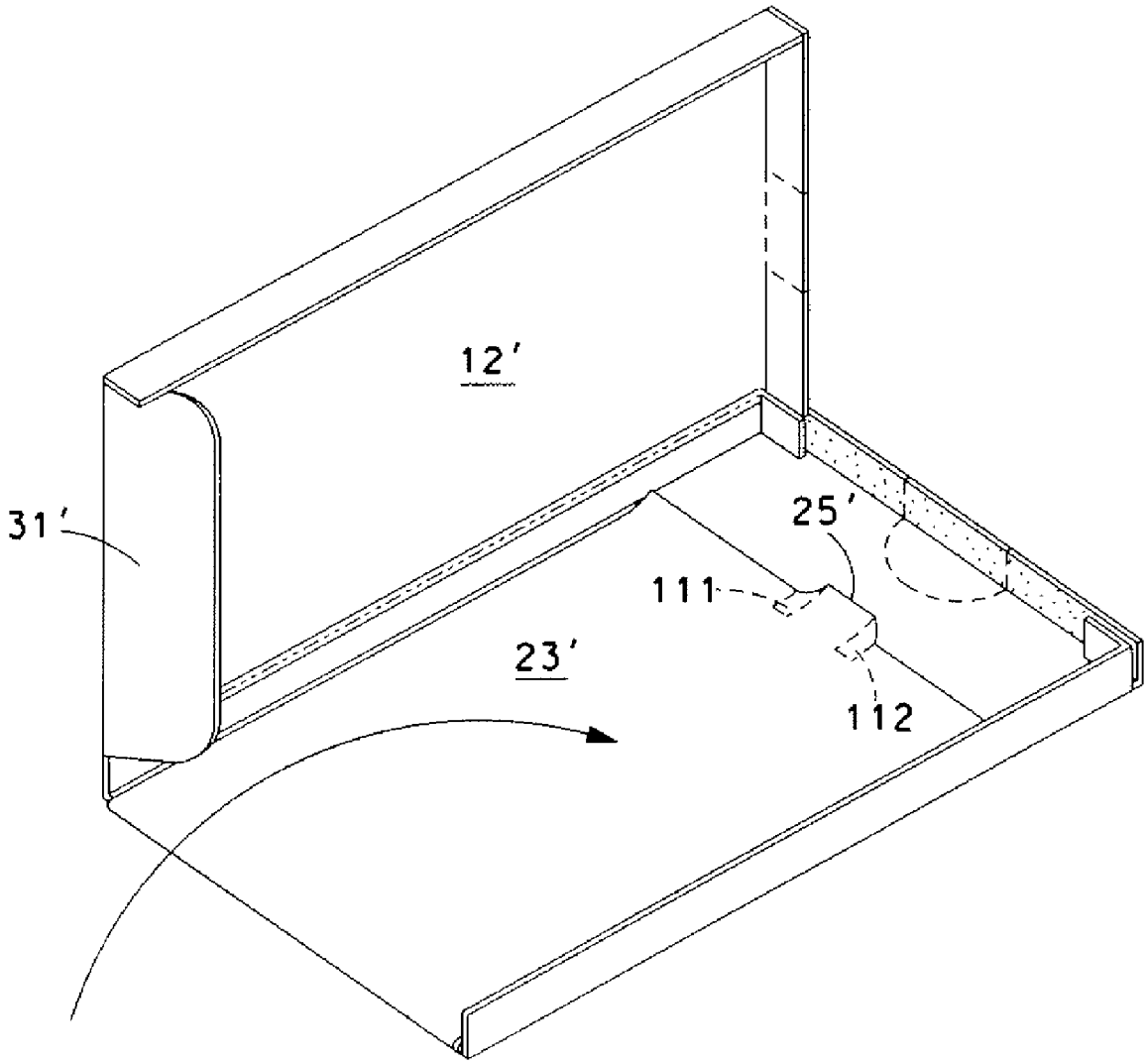
FIG. 19 is a perspective view showing the blank of FIG. 18 partially folded to make the third embodiment of sleeve according to the invention.
Figure 20:
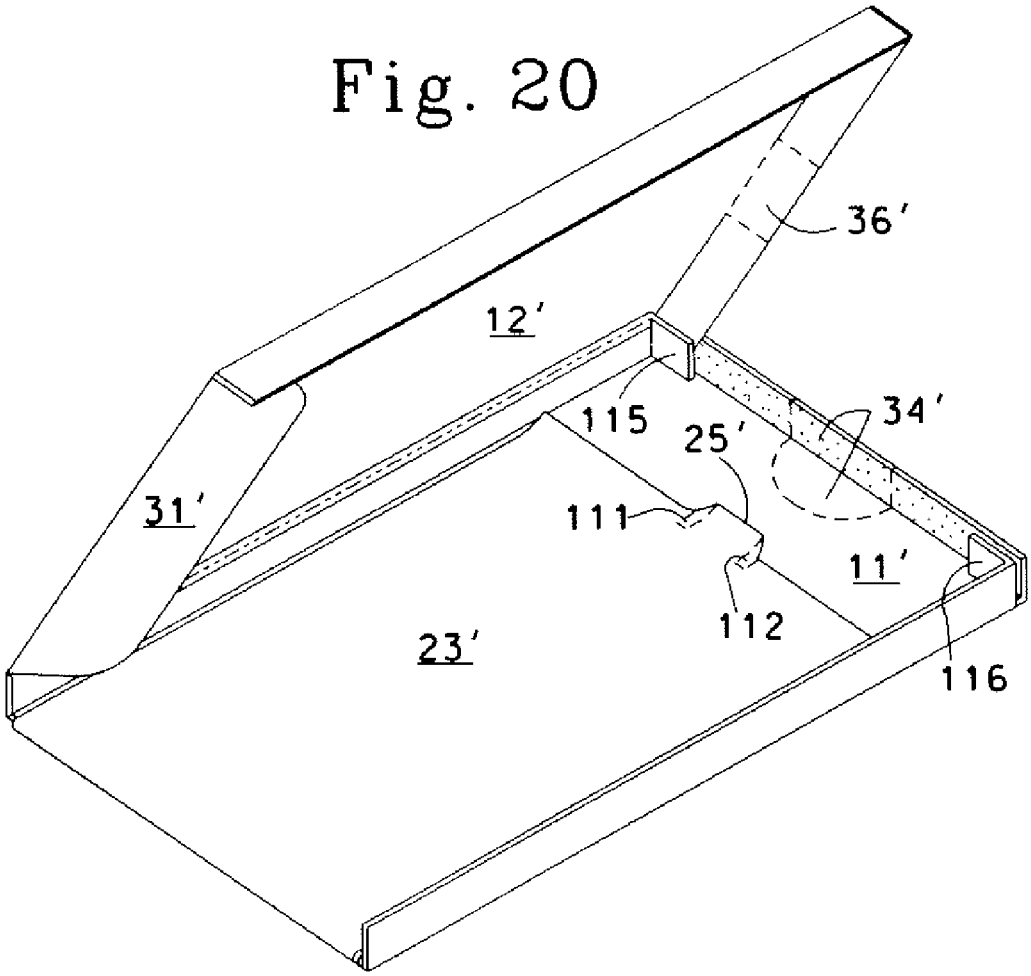
FIG. 20 is a perspective view showing the blank of FIG. 18 further folded to make the third embodiment of sleeve.

A blank 110 for making a third embodiment of sleeve according to the invention is shown in FIG. 18, which is an outside view of the blank. This embodiment closely resembles the first embodiment, and the same reference characters, primed, are used in this figure to describe corresponding parts to those in the first embodiment shown in FIG. 1. Thus, the blank 110 comprises two major panels 11' and 12' that form the top and bottom walls of a sleeve erected from the blank, a first minor panel 13' connected between adjacent side edges of the major panels and that forms one sidewall of a sleeve erected from the blank, and second and third minor panels 14' and 15' on opposite side edges of the respective major panels. Adhesive 16' is applied to the surface of one of the minor panels 14' or 15' (shown applied to the panel 14' in this embodiment), and in a sleeve erected from the blank the panels 14' and 15' are overlapped and glued together to form a second sidewall of the sleeve. The minor panels are joined to the major panels along parallel creased fold lines 17', 18', 19' and 20'.

A first flap 21' is foldably joined to one end of the major panel 11' along a creased fold line 22', and a latch panel 23' of slightly smaller dimensions than the panel 11' is foldably joined along a creased fold line 24' to the end of the panel 11' opposite the flap 21'. A narrow latch tab 25' projects from the free end of the latch panel, and a pair of small oppositely directed flaps 111 and 112 are joined to opposite side edges of the tab along diagonal creased fold lines 113 and 114. Adhesive 27' is applied to the flap 21', and adhesive 28' is applied to a midportion of the latch panel, extending over most of the area of the panel but spaced from opposite side and end edges thereof. It will be noted that in this embodiment the adhesive 28' extends closer to the side edges of the panel 23' than in the first embodiment, but it still remains spaced a substantial distance from the end of the panel having the latch tab.

A second flap 29' is foldably joined along a creased fold line 30' to that end of the major panel 12' that is adjacent the first flap, and the first and second flaps are overlapped and glued together in a sleeve erected from the blank to form one end wall. An extension panel 31' is joined along a creased fold line 32' to the end of the major panel 12' opposite the end to which the second flap is attached. It will be noted that the extension panel has a slightly narrower length than in the first embodiment.

A first line of perforations 33' define a first tear-out panel 34' in a midportion of the first flap 21' and an adjacent portion of the major panel 11', and a second line of perforations 35' define a second tear-out panel 36' in a midportion of the second flap 29'. In a sleeve erected from the blank, the first and second tear-out panels overlie one another and are removed together to form a finger access opening as described hereinafter.

This third embodiment of the invention also has small rectangular tabs 115 and 116 foldably connected to the ends of the minor panels 13' and 14', respectively, similar to the arrangement shown in the FIG. 14 embodiment.

Figure 21:
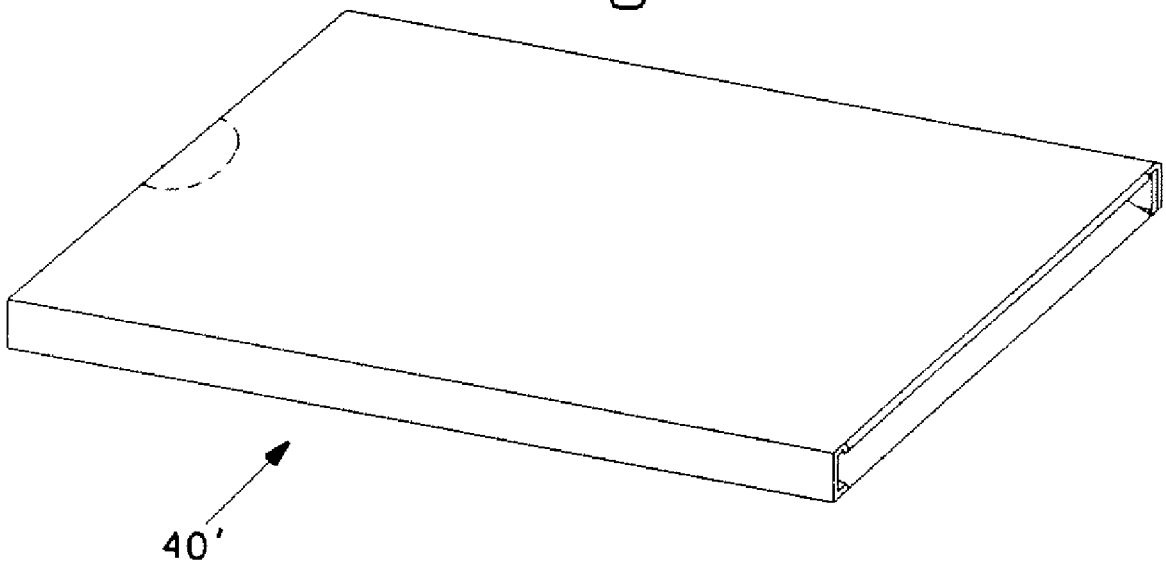
FIG. 21 is a perspective view of the third embodiment of sleeve, shown fully erected.

The erection of this form of the invention is essentially the same as in the FIG. 1 embodiment, except that the tabs 115 and 116 are folded inwardly and glued to the inside surface of the flaps 21', 29', and the small flaps 111 and 112 are folded inwardly about the fold lines 113 and 114 so that these flaps extend rearwardly at an angle beneath the tab 25' and the end of the latch panel 23'. The memory of these folded flaps urges the free end of the latch panel toward the interior of the sleeve, where the tab 25' can be engaged by the latch tab 63 on the blister card. The resulting sleeve 40' is shown in FIG. 21.

The principle of operation of the third embodiment is the same as in the first embodiment, and the same blister card is and/or can be used.

Fourth Embodiment

Figure 22:
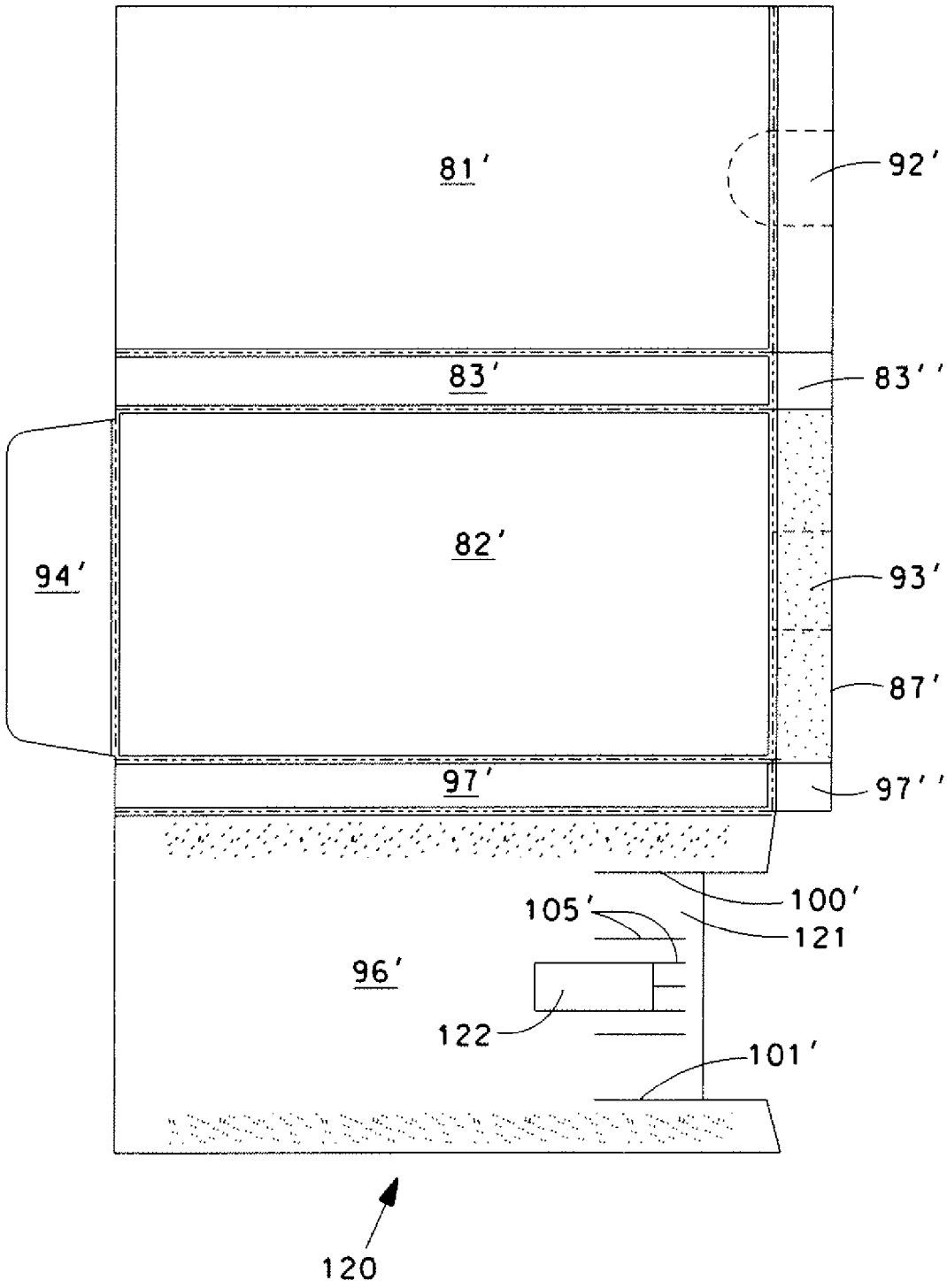
FIG. 22 is a plan view of a blank for making a fourth embodiment of sleeve according to the invention.
Figure 23:
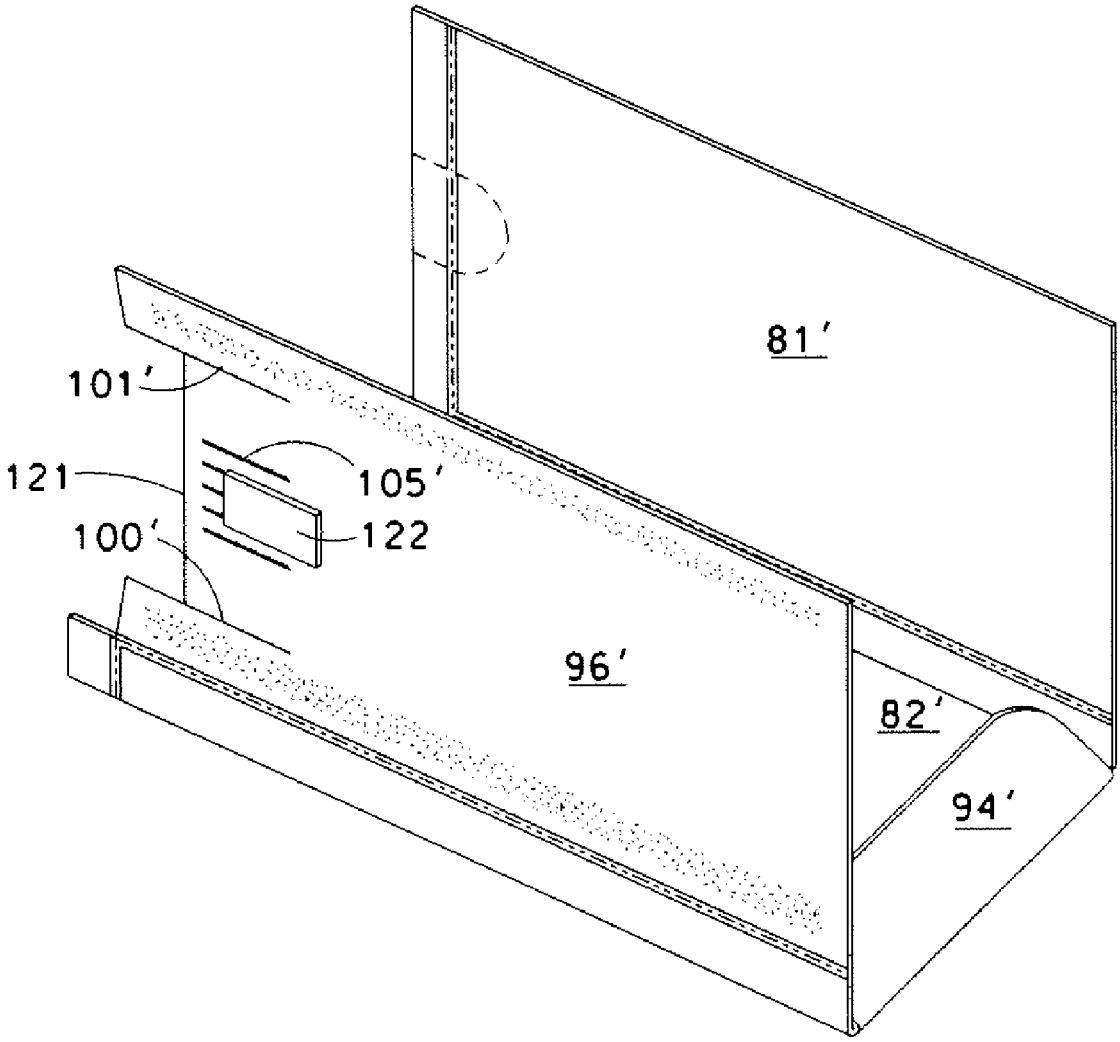
FIG. 23 is a perspective view showing the blank of FIG. 22 partially folded to make the fourth embodiment of sleeve according to the invention.
Figure 24:
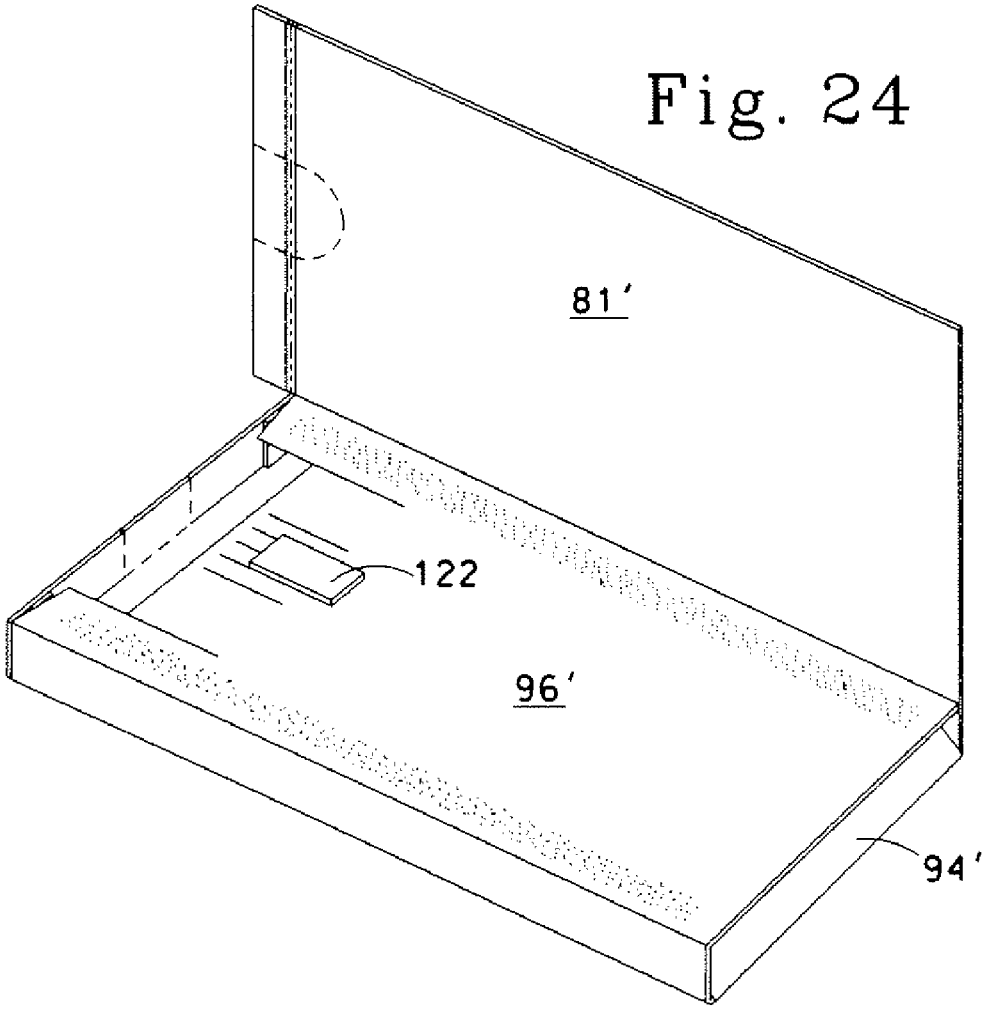
FIG. 24 is a perspective view showing the blank of FIG. 22 further folded to make the fourth embodiment of sleeve.
Figure 25:
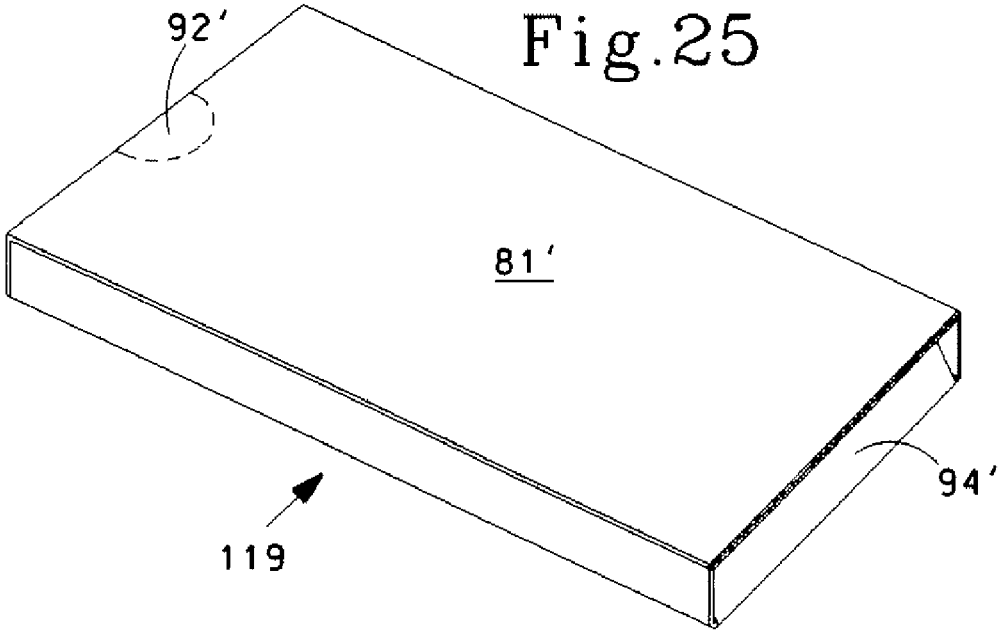
FIG. 25 is a perspective view of the fourth embodiment of sleeve, shown fully erected.

A blank 120 for making a fourth embodiment of sleeve 119 for use in the invention is shown in FIG. 22. This embodiment is similar to the second embodiment shown in FIG. 14, except that the second extension flap 98 used in the FIG. 14 embodiment is omitted, and instead of the foldable flap 104 and fold crease 103 of the previous embodiment, the latch tab 121 is biased toward the interior of the sleeve by a small rectangular piece of foam tape 122. An ordinary skilled in the art would appreciate that materials other than foam may be used. The rest of the structure is essentially the same as in the FIG. 14 embodiment and the same reference characters, primed, are used to refer to corresponding parts.

The principle of operation of the fourth embodiment is the same as in the first embodiment, and the same blister card is used.

Fifth Embodiment

Figure 26:
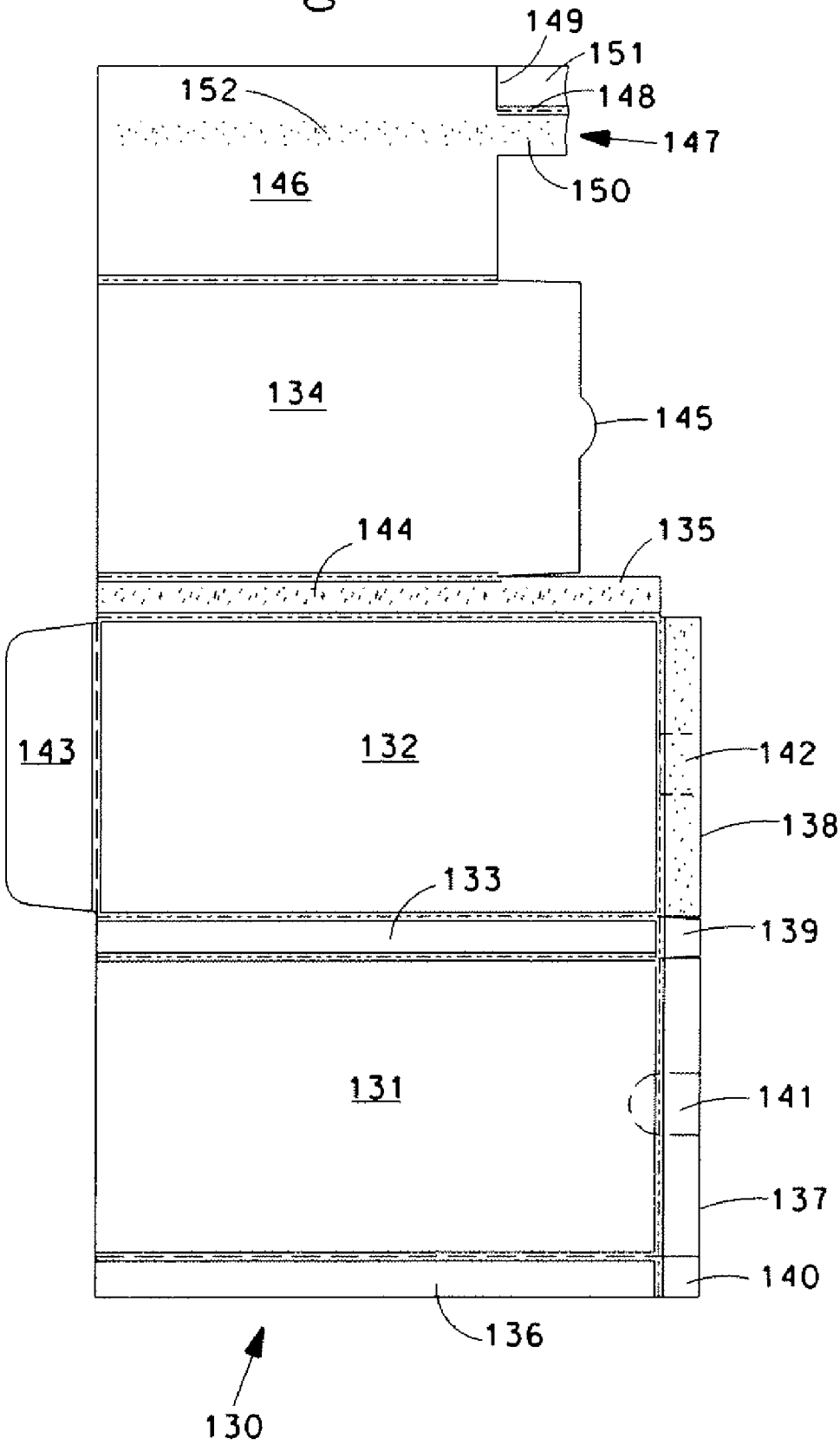
FIG. 26 is a plan view of a blank for making a fifth embodiment of sleeve according to the invention.

A blank 130 for making a fifth embodiment of sleeve 129 for use in the invention is shown in FIG. 26. In this form of the invention first and second major panels 131 and 132 are foldably joined along one side edge by a first minor panel 133, and a latch panel 134 is foldably joined to an opposite side edge of one of the major panels 132 by a second minor panel 135. A third minor panel 136 is on the side edge of the first major panel 131 opposite the edge connected to minor panel 133, and first and second end flaps 137 and 138 are foldably joined to respective adjacent ends of the respective major panels. Small rectangular tabs 139 and 140 are foldably joined to the ends of the first and third minor panels adjacent the end flaps, and tear-out panels 141 and 142 are formed in the respective end flaps. An extension panel 143 is foldably joined to an end of major panel 132 opposite the end having the end flap. In a sleeve erected from the blank the extension panel forms a retaining means to prevent complete separation of the blister card insert from the sleeve, as described in connection with the previous embodiments. Adhesive 144 is applied to at least one of the minor panels and to at least one of the end flaps, and in a sleeve erected from the blank the end flaps are overlapped and glued together to form an end wall, the second and third minor panels are overlapped and glued together to form one side wall, and the first minor panel forms an opposite side wall.

Figure 27:
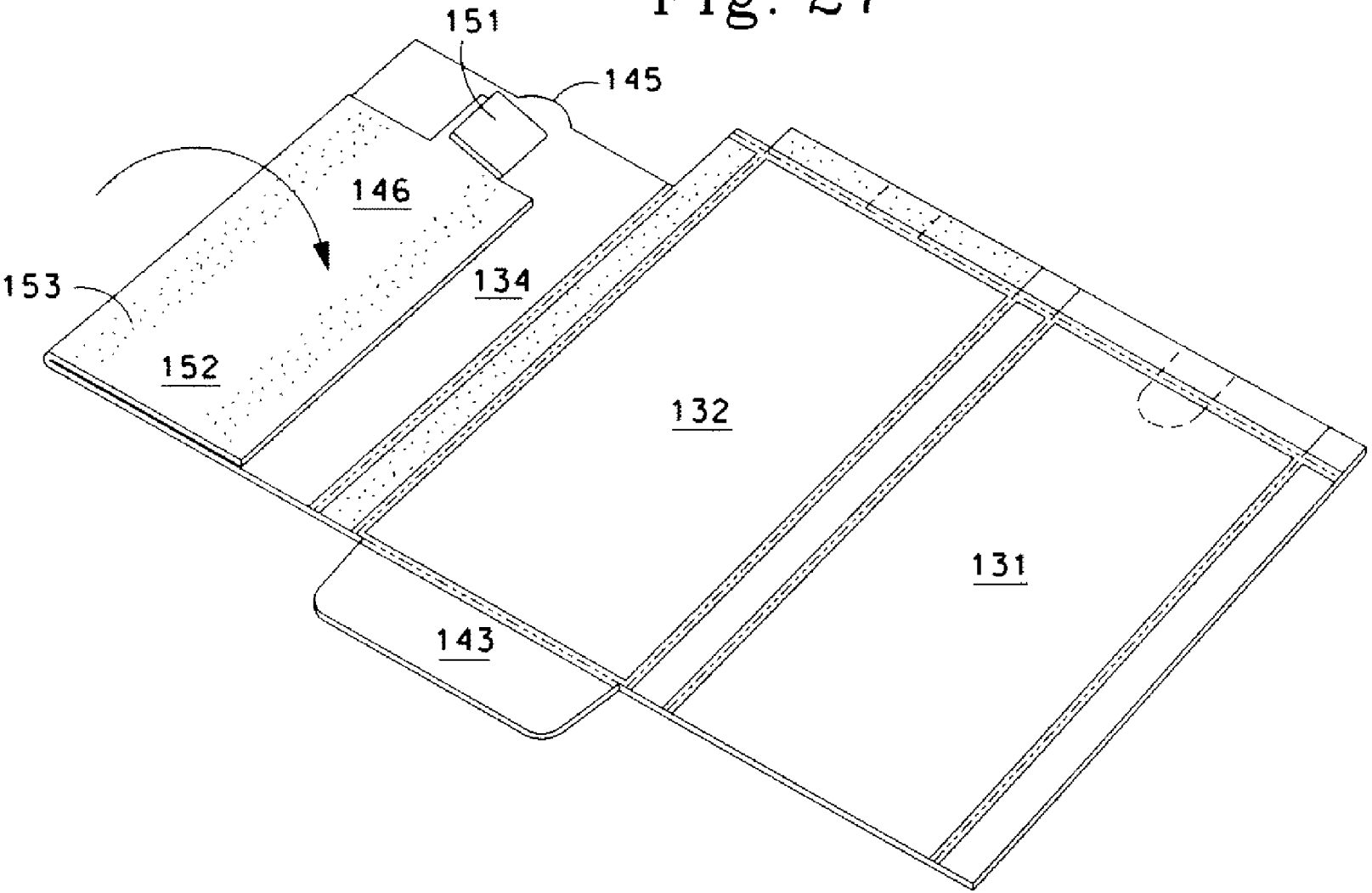
FIG. 27 is a perspective view showing the blank of FIG. 26 partially folded to make the fifth embodiment of sleeve.
Figure 28:
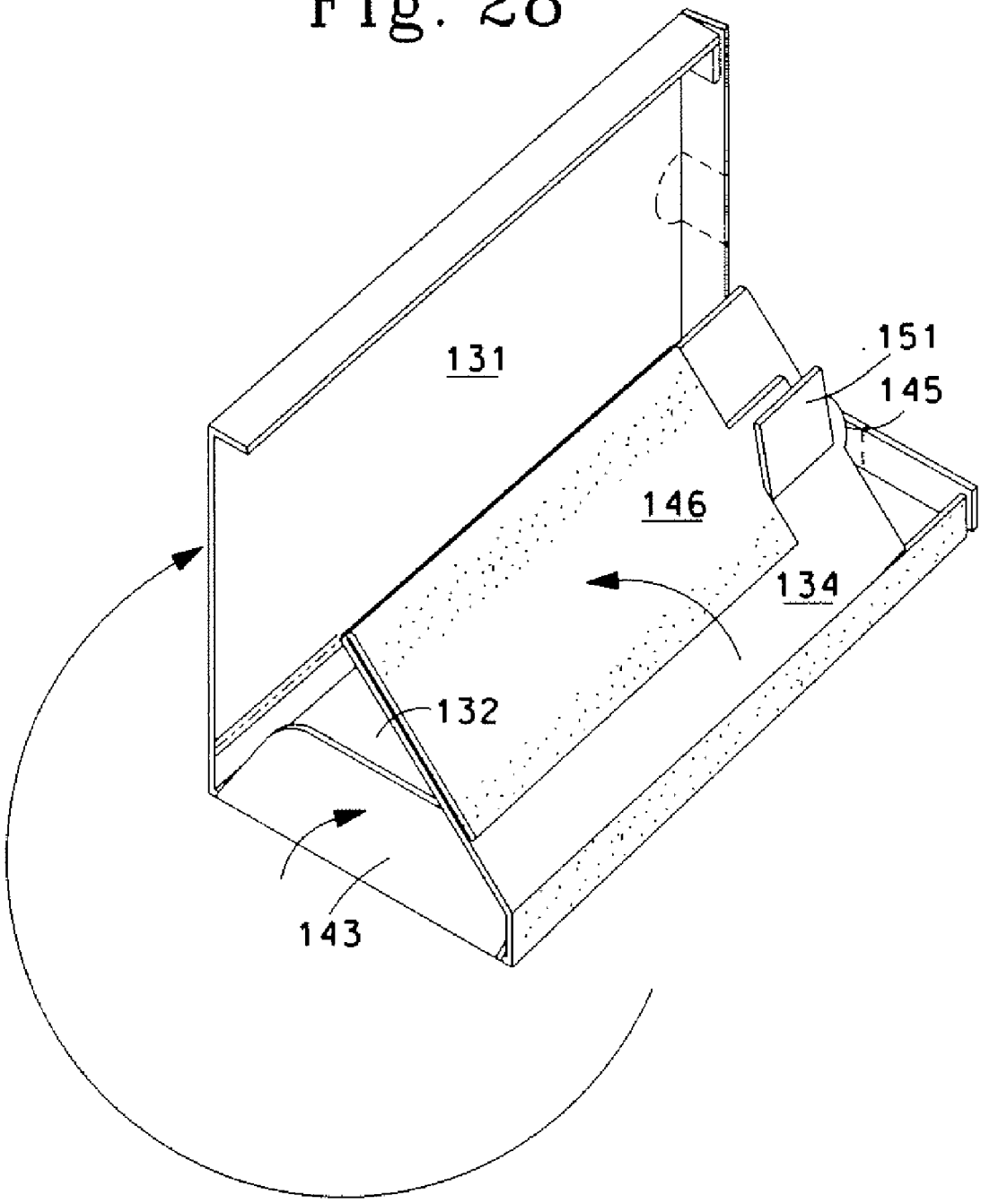
FIG. 28 is a perspective view showing the blank of FIG. 26 further folded to make the fifth embodiment of sleeve according to the invention.
Figure 29:
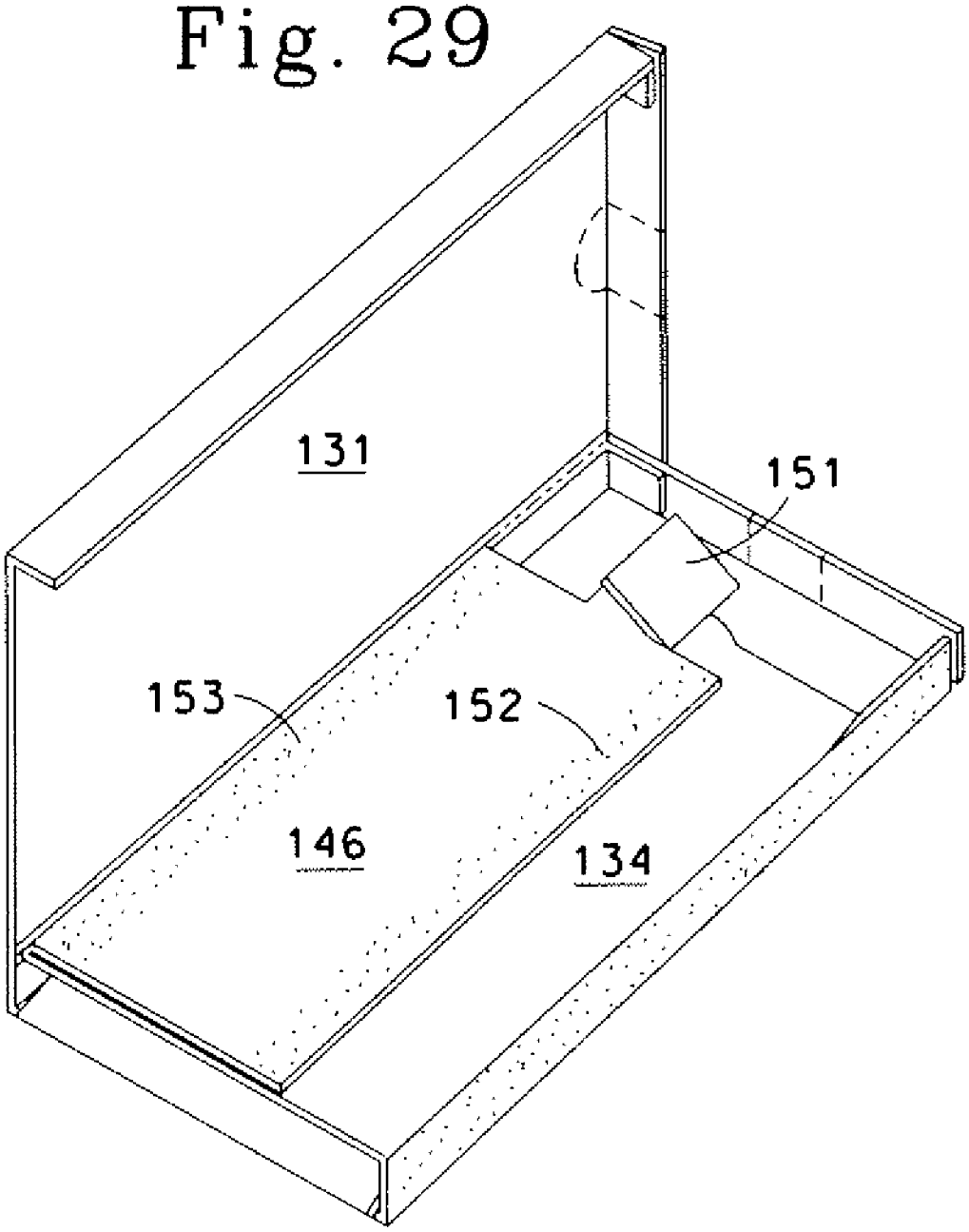
FIG. 29 is a perspective view showing the blank of FIG. 26 folded still further to make the fifth embodiment of sleeve.
Figure 30:
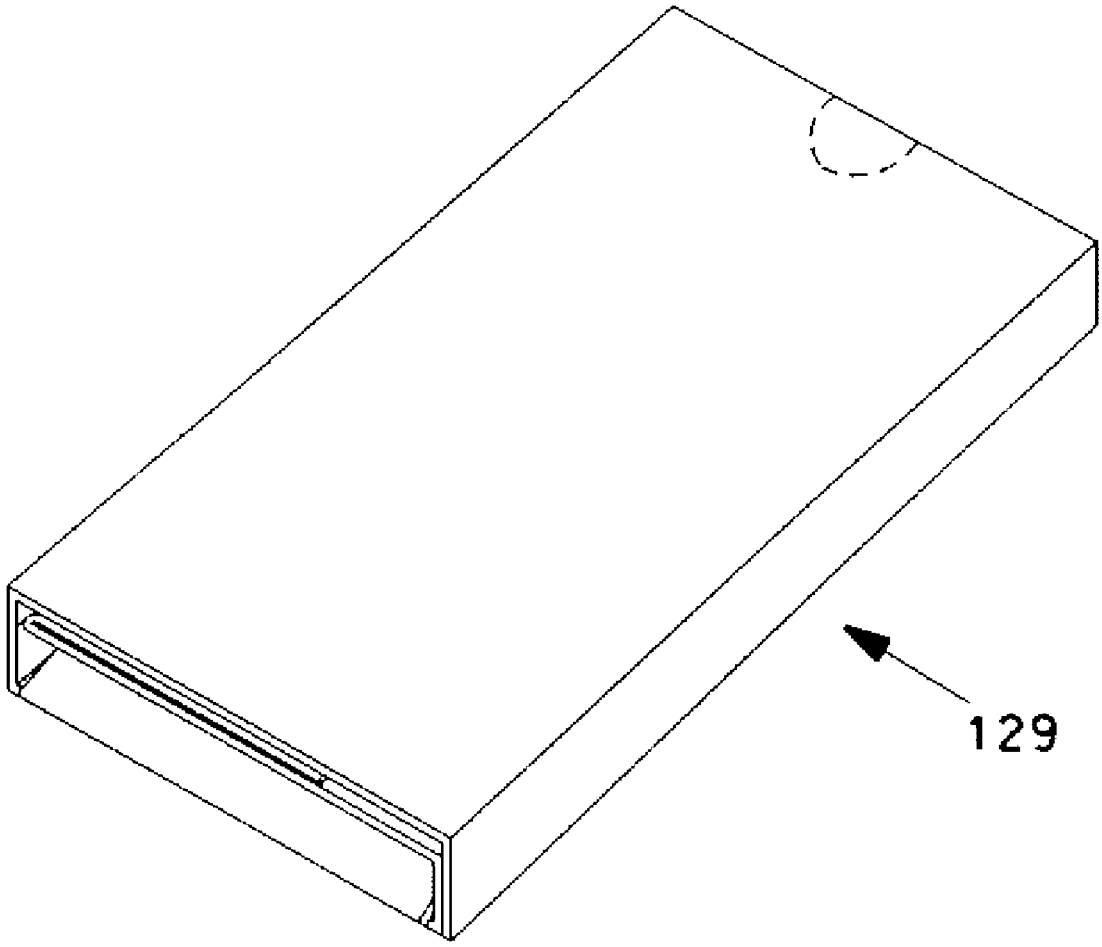
FIG. 30 is a perspective view of the fifth embodiment of sleeve, shown fully erected.

This form of the invention differs primarily from previous embodiments in the construction of the latch panel that cooperates with the latch tab on the blister card insert to hold the blister card insert in the sleeve. In this form of the invention the latch panel 134 has a small latch tab 145 projecting from one end thereof, and an auxiliary panel 146 is foldably joined to the side edge of the latch panel opposite its folded connection with major panel 132. The auxiliary panel is shorter in length than the latch panel, which in turn is shorter in length than the adjoining major panel. A biasing tab 147 extends from the end of the auxiliary panel and terminates at its outer end in approximate alignment with the adjacent end of the auxiliary panel. The biasing tab is bifurcated by a longitudinally extending fold crease 148, and a cut 149 extends laterally across a base end of the biasing tab from its outer side edge to the fold crease, defining a fixed tab portion 150 and a foldable tab portion 151. A band of adhesive 152 is applied lengthwise of the auxiliary panel and the fixed tab portion, and when the blank is folded and glued to form the sleeve 129 as depicted in FIGS. 27-30, the auxiliary panel and fixed tab portion are glued to the latch panel, with the foldable tab portion 151 folded inwardly as shown in FIGS. 27 and 28 so that it lies between the major panel 131 and fixed tab portion 150. Bands of adhesive 152 and 153 also extend along opposite side edges of the back of the auxiliary panel, and the major panel 131 is adhered to the auxiliary panel by these bands of adhesive. The auxiliary panel reinforces the latch panel and sleeve, and the foldable tab portion 151 biases the latch tab 145 toward the interior of the sleeve for cooperation with the catch 25 on the blister card insert as described previously.

Blister Card Insert Incorporating Circuitry

Figure 31:
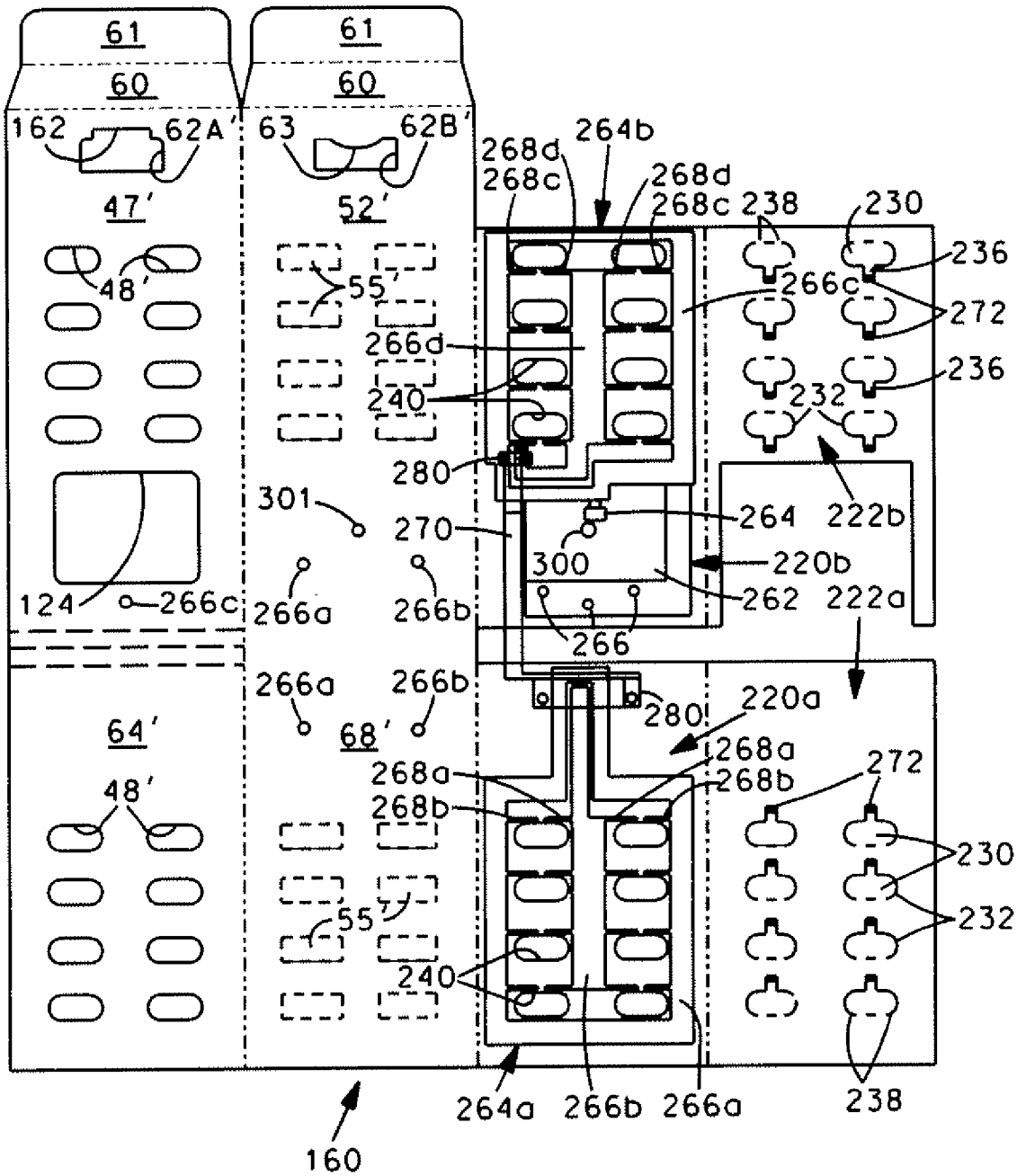
FIG. 31 is a plan view of a blister card insert incorporating the child resistant features of the invention, and having electronics applied to the insert to detect dispensing of product and for providing an alert that the package is open.

FIG. 31 depicts a blank 160 for making a blister card insert that incorporates circuitry, indicated generally at 260, for providing an alert when the package is left open and/or for monitoring the dispensing of pills from the package. This form of blister card insert, as well as the first form described, can be used with any of the forms of sleeve described herein, and functions generally the same as that form of the invention shown in FIG. 7A in applicant's commonly owned copending application Ser. No. 11/637,385, except that it incorporates the child-resistant features described herein, and a total of sixteen blisters are shown in this embodiment instead of the thirty blisters shown in FIG. 7A of the prior application. Some modifications have been made to the circuitry, as described below. The same reference characters, primed, are used to designate corresponding parts in this embodiment and in the first embodiment described above, and to designate corresponding parts in this embodiment and in the FIG. 7A embodiment of the copending application.

Thus, the blister card includes first, second, third and fourth foldably interconnected panels 47', 52', 64' and 68', with openings 48' in panel 47', punch-out areas 55' in panel 52', foldable panels 60 and 61 on the ends of panels 47' and 52', and openings 62A' and 62B, all as in the first embodiment described above. It will be noted that one side edge of opening 62A' is cut away at 162, whereby a latch tab 63 is formed on only one of the panels 52' when the panels are overlapped and glued together.

Each of the blister panels 47', 64' includes a 2D matrix of openings 48', and each of the panels 52', 68' includes punch out areas 55'. The openings and punch out areas are in aligned registry with one another when the panels 47' and 64' are folded onto the panels 52' and 68'. The panels 47' and 64' are referred to hereinafter as blister panels.

Figure 32:
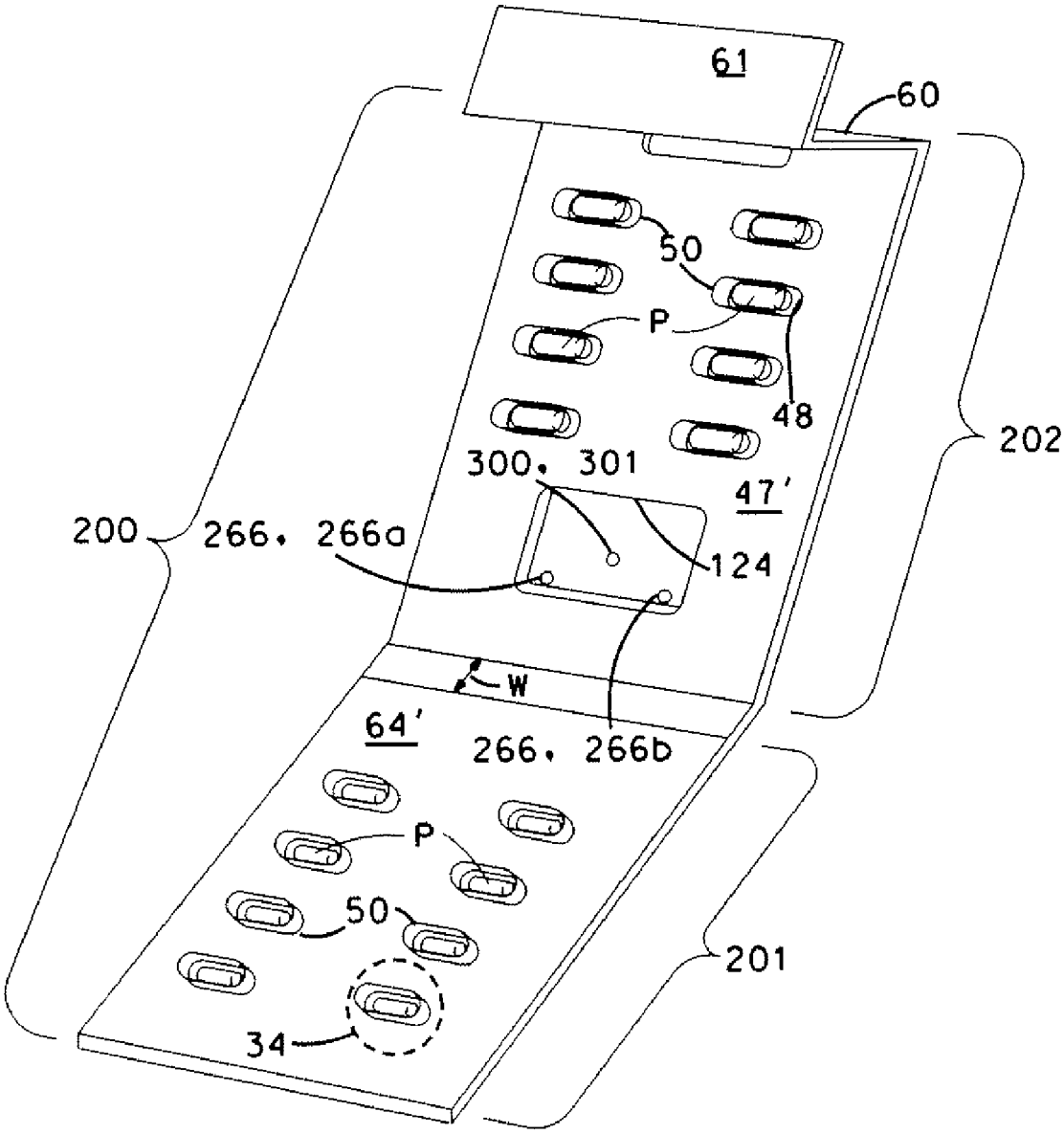
FIG. 32 is a perspective view of the blister card insert of FIG. 31, shown removed completely from the sleeve and unfolded.

As in the FIG. 7A embodiment of the applicant's commonly owned copending application Ser. No. 11/637,385, the disclosure of which is incorporated by reference in full herein, opposing circuit panels 220*a* and 220*b* are foldably joined along one side edge to a side edge of panels 52' and 68', respectively, and opposing contact panels 222*a* and 222*b* are respectively foldably joined to the opposite side edges of the circuit panels. The contact panel 222*b* includes a rectangular cut out 228 in one edge, and blister panel 47' includes an opening 124 which cooperates with the cut out 228 to permit the microprocessor 262 (see below) to be exposed from the blister panel 47' when the blank 160 is folded to form the package assembly 200, having two foldably connected blister pack units 201 and 202, as depicted in FIG. 32. It should be noted that the cut out 228 and the opening 124 are not critical to the practice of the invention. In the absence of the cut out 228 and the opening 124, the circuitry unit 260 would be concealed between the blister panel 47 and contact panel 222*a* when the blank 160 is in the folded position as shown in FIG. 32.

Each of the contact panels 222*a*, 222*b* includes a 2D matrix of individual swing doors 230 that are each defined by non-continuous score lines 232. FIG. 31 illustrates a total of sixteen swing doors 230 that are substantially oval in shape and positioned approximately in the center of the contact panels 222*a*, 222*b*. It should be noted that the number of swing doors 230 shown in FIG. 31 corresponds to the number of blister cavities and associated openings and is strictly exemplary in nature and is in no way intended to limit the number of blisters and associated swing doors 230 that can be included in the package assembly 200. Furthermore, each swing door 230 preferably stands alone and is not connected with another swing door 230. The score lines also delineate a generally rectangular tab 236 projecting outwardly from one long side of each swing door 230. The non-continuous score line 232 is interrupted by a pair of small webs 238 that hold the swing door 230 in the plane of the respective associated contact panel 222*a* and 222*b* and permit the swing door 230 to pivot in and out of the plane of the respective panel 222*a* and 222*b*. A person of ordinary skill in the art would appreciate that the pair of webs 238 functions like a typical door hinge which permits the swing door 230 to pivot along an axis aligned with a second long side of the generally oval portion 234 opposite the tab 236.

Each of the circuit panels 220*a* and 220*b* includes a 2D matrix of punch outs 240 that correspond to the number of blisters 50 in blister panels 47' and 64', and swing doors 230 in the contact panels 222*a* and 222*b*. Each of the punch outs 240 is aligned with the corresponding swing door 230 to be used in forming an electronic momentary switch 290 (see FIG. 33) when the blank 160 is in the folded position, as described hereinafter. The punch outs 240 are positioned approximately in the center of circuit panels 220*a*, 220*b*. It should be noted that the number of punch outs 240 shown in FIG. 31 is dependent upon the number of blisters incorporated in the package and is strictly exemplary in nature and is in no way intended to limit the number of blisters and associated punch outs 240 that can be included in the package assembly 200. Furthermore, each punch out 240 preferably stands alone and is not connected with another punch out 240. Although the punch outs 240 are illustrated as being oval, it should be noted that it is within the scope of this invention to provide punch outs 240 of any known shape, such as, for example, but not limited to, rectangular, circular, triangular, trapezoidal, square, and the like.

The openings 48', punch out areas 55', swing doors 230, and punch outs 240 are in aligned registry with one another when the blank 160 is in the folded position, and the panels 52' and 68' form the back surface of the package assembly 200. The back surface of the package assembly may be used to print, for example, a doctor's or pharmacists' instructions, graphics, comments and the like. The respective blister panels 47', 64' form the front surfaces of the package assembly, as best shown in FIG. 32. It should be noted that the number of blisters and associated punch outs and openings is strictly exemplary in nature and is in no way intended to limit the number of blisters, punch outs and openings that can be included in the package assembly. Although the openings 48' and punch out areas 55' are illustrated as being oval, it should be noted that it is within the scope of this invention to provide punch outs of any known shape, such as, for example, but not limited to, rectangular, circular, triangular, trapezoidal, square, and the like.

The circuitry unit 260 is configured to be printed on the circuit panels 220*a*, 220*b*. As noted above, the circuitry unit 260 in cooperation with momentary switch 290, as described hereinafter, permits the accessing of pill P in each blister 50 to be monitored. As best illustrated in FIG. 31, the circuitry unit 260 comprises a microprocessor 262 having an audible piezo-alarm 264 and one or more light emitting diodes (LED's) 266, conductive circuits 264*a*, 264*b*, and other components such as a read-only-memory and a read-access-memory to keep track of the time to take the pill P and alert a patient if the pill P was not taken at the appropriate time. Holes 266*a*, 266*b* and 266*c* for the LED's are provided in the panels 52' and 68'. The microprocessor 262 may be adhesively attached to the circuit panel 220*b*, and communicates with the package assembly 200 via the conductive circuits 264*a*, 264*b*. Alternatively, one skilled in the art would appreciate that microprocessor 262 may be in optical communication with the package assembly 200. Holes 265 are provided through the back panel 52' to expose the LED's 266 through the opening 124 in front panel 47'.

The conductive circuits 264*a* and 264*b* on the circuit panels 220*a* and 220*b*, respectively, preferably consist of electrically conductive pathways or traces 266*a*, 266*b* and 266*c*, 266*d* that are printed, for example, graphically in the form of printing ink or applied by another method, for example, in the form of foil, onto the circuit panels 220*a* and 220*b* as best depicted in FIG. 31.

The conductive pathways 266*a*, 266*b* and 266*c*, 266*d* are configured differently than the generally U-shaped configuration employed in applicant's commonly owned copending application Ser. No. 11/637,385, the disclosure of which is incorporated by reference in full herein. In the exemplary embodiment shown herein, the respective conductive pathways 266*a* and 266*c* comprise generally rectangularly shaped outer traces, and the conductive pathways 266*b* and 266*d* comprise elongate straight traces extending generally centrally of the rectangular pathways. The shapes of the traces are selected to minimize the space needed to print the conductive pathways 266*a*, 266*b* and 266*c*, 266*d* on their respective circuit panels 220*a* and 220*b*. The conductive circuits 264*a*, 264*b* function similarly to that used, for example, in parallel switches. It will be appreciated that the pattern configurations of conductive pathways 266*a*, 266*b* and 266*c*, 266*d* are only exemplary and by no means limited to the pattern shown. It is well within the scope of this invention that the conductive pathways 266*a*, 266*b* and 266*c*, 266*d* could have other geometrical shapes. Each of the conductive pathways 266*a*, 266*b* on circuit panel 220*a* includes a plurality of conductive contact surfaces 268*a* and 268*b*. Similarly, each of the conductive pathways 266*c*, 266*d* on circuit panel 220*b* includes a plurality of conductive contact surfaces 268*c* and 268*d*.

In the exemplary embodiment of FIG. 31, the pattern of the conductive circuits 264*a*, 264*b* corresponds to the 2D matrix of the punch outs 240 contained in the circuit panels 220*a*, 220*b*. For example, in the circuit panel 220*a*, each punch out 240 includes a pair of spaced apart contact surfaces 268*a*, 268*b* that is printed on one of the long sides of the punch out 240. Alternatively, the pair of contact surfaces 268*a*, 268*b* may be printed on one of the short sides of the punch out 240, provided that respective conductive contacting surfaces 272 on the tabs 236 attached to the swing doors are re-configured such that the pair of contact surfaces 268*a*, 268*b* is symmetric with respect to the contacting surfaces 272. For example, if the contact surfaces 268*a*, 268*b* are printed on one of the short sides of the punch out 240, then the respective conductive contacting surfaces 272 must also be applied on the short side of the respective swing doors 230. It should be noted that all of the contact surfaces 268*a* are branched out from the conductive pathway 266*a*, and all the contact surfaces 268*b* are branched out from the conductive pathway 266*b*.

Similarly, in the circuit panel 220*b* each punch out 240 includes a pair of spaced apart contact surfaces 268*c*, 268*d* that are printed on one of the long sides of the punch out 240. It should be noted that all the contact surfaces 268*c* are branched out from the conductive pathway 266*c* and all the conductive contact surfaces 268*d* are branched out from the conductive pathway 266*d*. It should be noted that the configuration of conductive pathways 266*a*, 266*b* and 266*c*, 266*d* substantially reduces the number of the electrical contacts needed to communicate with the microprocessor 262.

The conductive paths 264*a*, 264*b* are connected to the microprocessor 262 via a flexible circuit 270. The flexible circuit 270, due to its inherent toughness, can resist a multiple folding without any damage to the wires. The flexible circuit 270 is connected to the conducting pathways 266*a*, 266*b* and 266*c*, 266*d* by a Z directional electrically conductive tape 280. The Z directional electrically conductive tape 280 is similar to a two sided tape that conducts electricity only up and down through its thickness "z-direction" as well known in the art. The Z directional conductive tape 280 does not conduct across the surface of the circuit panels 220*a*, 220*b* in the X and Y directions. Advantageously, the Z directional conductive tape 280 could be applied over two conductive traces that are next to each other without connecting them to each other or "shorting them out". One having ordinary skill in the art would appreciate that a Z directional conductive adhesive may be used for the practice of the present invention. The Z directional conductive tape 280 is also known as anisotropic electrically conductive tape. Alternatively, It should be noted that a standard conductive adhesive may be applied over two conductive traces that are next to each other, however, one ordinary skill in the art would know that the standard conductive adhesive have to be applied in a manner that a small amount is applied to each conductive trace so it would not spread out and touch the other adjacent contact surfaces 268*a*, 268*b* and 268*c*, 268*d*. It should be noted that contact surface 266*a* cannot be connected to contact surface 266*b* and contact surface 266*c* cannot be connected to contact surface 266*d*.

As in applicant's commonly owned copending application Ser. No. 11/637,385, the disclosure of which is incorporated by reference in full herein, the microprocessor 262 may be programmed to keep track of the time to take the pill and alert a patient if the pill P was not taken at the appropriate time, and/or to establish a desired pill schedule and to store in the memory the actual dispensing times of the pills P, with the audible piezo-alarm 264 sounding to indicate to the patient that it is time to take the pill according to the programmed pill schedule, and/or to keep track of the untaken pills. The light emitting diode (LED) 266 is a semiconductor that emits light when electrically energized and is used as a small indicator light to visually alert a patient.

Additionally, in the present embodiment shown in FIG. 31 and as described hereinafter, a photosensor or microswitch 300 may be incorporated in the package to provide a signal to the electronic device so that a visual or audible alert is given when the blister card insert is not replaced in the sleeve following dispensing of a pill.

When the contact panels 222*a*, 222*b* overlay the respective circuit panels 220*a*, 220*b*, each of the respective swing doors 230 in cooperation with each of the punch outs 240 forms a momentary switch 290. This switch is open and no circuit is completed unless a pill is being dispensed. However, when a pill is dispensed the contacting surface 272 on the tip of the rectangular tab 236 slides over the conductive contact surfaces 268*a*, 268*b* and 268*c*, 268*d* establishing electrical communication between the respective conductive contacting surfaces 272 and 268*a*, 268*b* and 268*c*, 268*d*, as described more fully below.

For the sake of brevity, the structure and function of only one momentary switch 290 and associated blister cavity 50 having a pill P therein is discussed below, but it should be understood that an identical structure and function applies to each blister cavity and associated structure. The fragmentary portion described in detail hereinafter is indicated by the circled area 33, 34 in FIG. 32.

Figure 33:
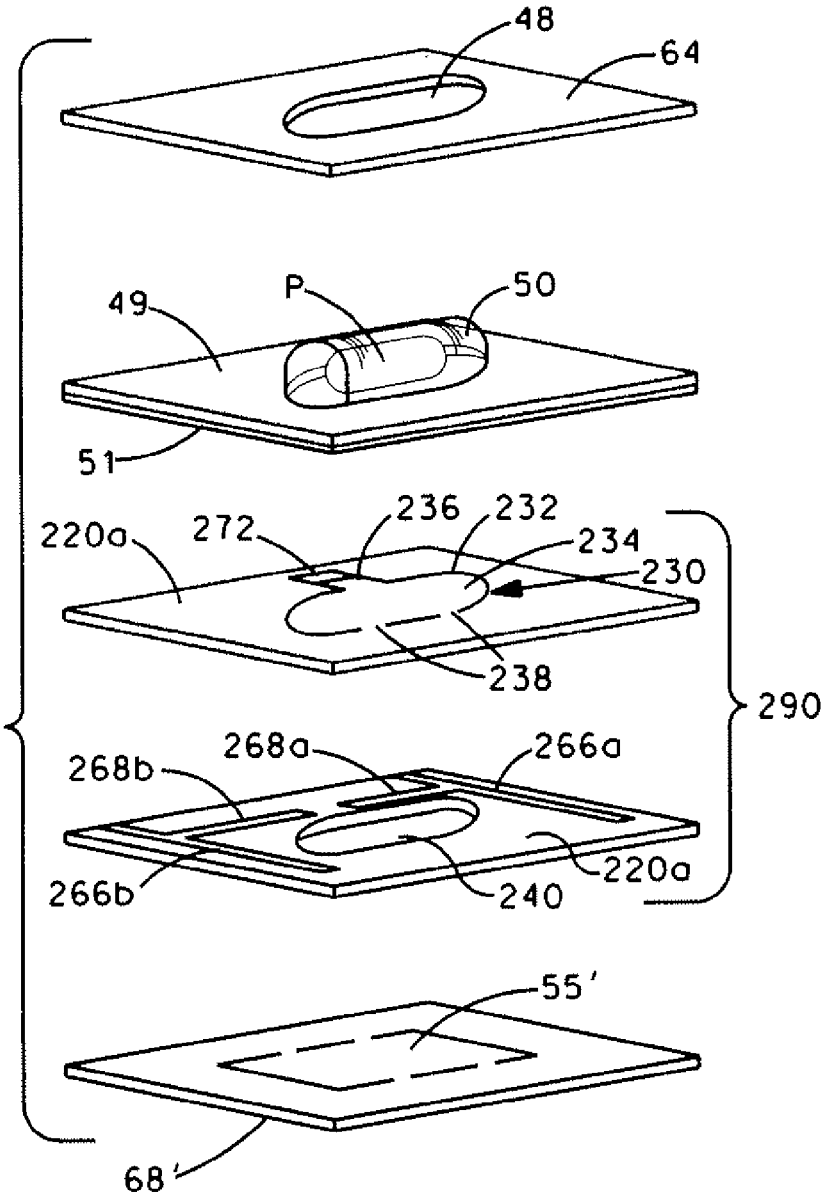
FIG. 33 is a fragmentary exploded perspective view depicting one blister pill unit of the blister card insert of FIG. 32.

FIG. 33 is an exploded perspective view of that portion of the package circled in FIG. 32, and illustrates the assembly of one of the blister cavities 50 and associated package components and circuitry forming the momentary switch 290 in accordance with a preferred embodiment of the present invention. One of ordinary skill in the art would appreciate that this construction applies to the other blister cavities and associated package components and circuitry in the package of the invention.

Figure 34:
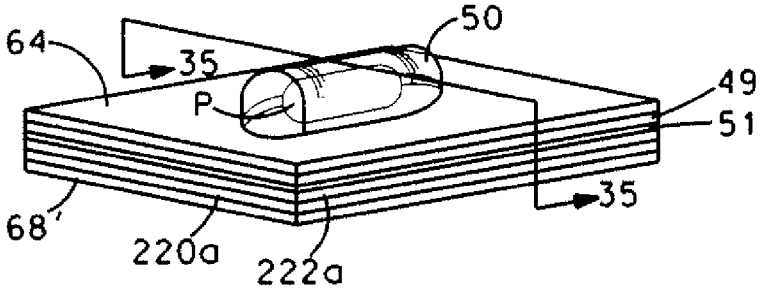
FIG. 34 is a perspective view of the blister pill unit of FIG. 33, shown in its normal assembled condition.
Figure 35:
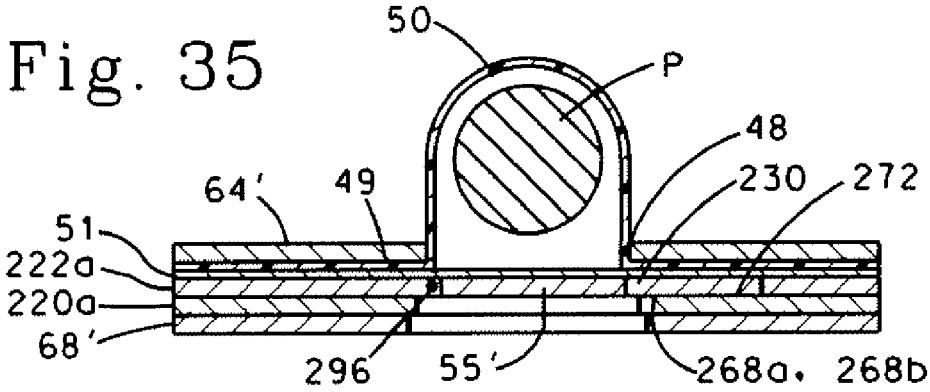
FIG. 35 is an enlarged sectional view taken along line 35-35 in FIG. 34, showing the condition of the blister pill unit prior to dispensing action.
Figure 36:
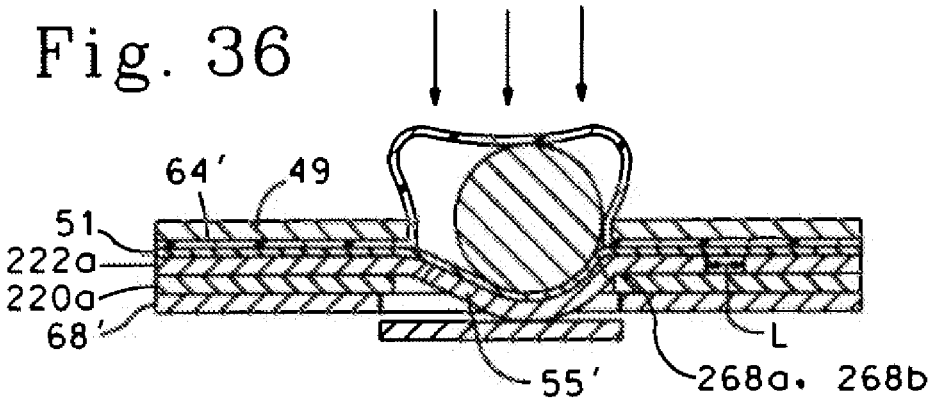
FIG. 36 is a view similar to FIG. 35, showing a first stage of a pill being dispensed, wherein the blister has been pushed against the pill to force it against the punch out and momentary switch, and showing the switch being moved.
Figure 37:
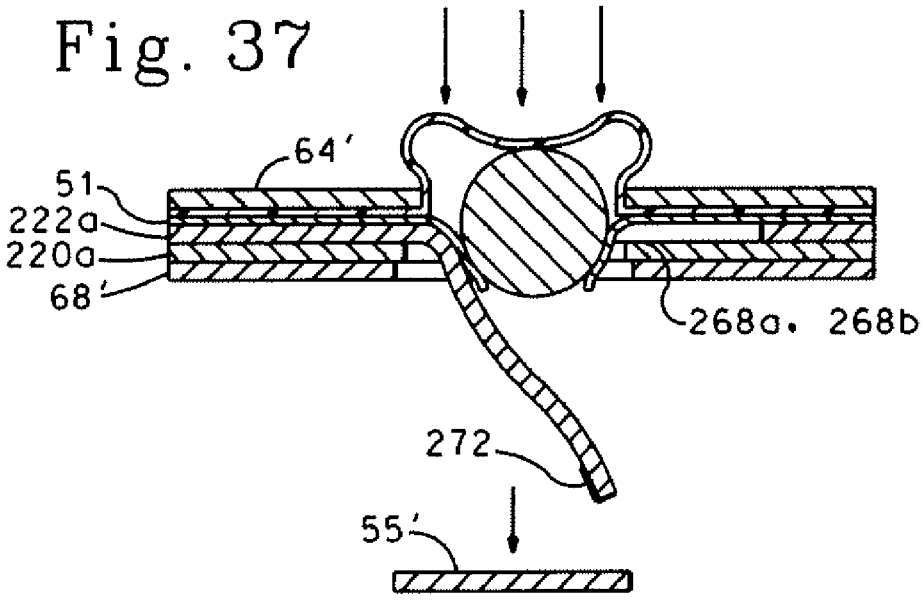
FIG. 37 is a view similar to FIG. 36, showing a final stage of dispensing, wherein the pill has been pushed through the punch outs of the blister pack and swing door of the circuit panel.

FIGS. 35-37 are cross sectional views of the fragmentary package assembly shown in FIG. 34. Thus, FIG. 35 is a sectional view taken along line 35-35 in FIG. 34, showing the disposition of the package components prior to a pill being dispensed, and FIGS. 36 and 37 depict the operation of momentary switch 290 during dispensing of a pill. As noted above, in the preferred embodiment of this invention the momentary switch 290 is used to monitor the dispensing of a pill P from the package assembly, but could also be used to provide an alert when the blister pack insert is not returned to its latched position within the sleeve.

FIG. 35 shows the momentary switch 290 in an open position in which the conductive contact surface 272 is spaced apart from the contacting surfaces 268*a*, 268*b*. As noted above, the respective contact surfaces 268*a*, 268*b* are symmetric with respect to the contacting surface 272 and lie in the same plane with one another, with the circuit panel 220*a* and the contact panel 222*a* lying parallel and contiguous to one another when a pill is not being dispensed, as shown in FIG. 35. In this position the contact surfaces 268*a* and 268*b* are out of alignment with the contact surface 272 and the switch is open. When a pill is being dispensed, as shown in FIGS. 36 and 37, the oval portion 234 of swing door 230 is forced downwardly, pulling the tab 236 from its at-rest position and causing the contacting surface 272 to slide over and establish contact with the contact surfaces 268*a* and 268*b*, closing the momentary switch. The contact panel 222*a* and the circuit panel 220*a* are sandwiched between the panels 64' and 68'. The punch out areas 55' in the exterior back panel 68' protect the circuit panel 220*a* from possible damage. Since the punch out areas 55' are used only for protection purposes, they are not a necessary component of the package assembly and can be omitted if desired, with these areas simply left open.

As discussed briefly before, the swing door 230 having the substantially rectangular tab 236 pivots with respect to hinge point 296. When the pill P is pushed out of the blister cavity 50, the pill breaks through the foil 51 and pushes down onto the swing door 230. In response, the swing door 230 pivots downwardly out of the plane of panel 222*a* as best illustrated in FIG. 36. It should be noted that the downward distance of the swing door 230 corresponds to the linear distance (L) which the tab 236 moved laterally with respect to the panel 222*a*. As the pill P continues to push out of the blister cavity 50, the tab 236 having conductive contacting surface 272 comes into sliding contact with the conductive contact surfaces 268*a*, 268*b* and puts the momentary switch 290 in closed position. During the sliding motion of tab 236 over the contact surfaces 268*a*, 268*b*, the momentary switch remains in closed positioned. As the pill continues to move outwardly from the blister cavity 50, the contacting surface 272 is disengaged from the contact surfaces 268*a*, 268*b*, which puts momentary switch 290 back in the opened position. The punch out area 55' is now separated from the exterior panel 68'. It is also possible to remove the tear away door prior to attempting to push the pill out of the package. The pill is dispensed from the blister cavity 50 when the tab 236 is passed through the punch out 240. It should be noted that the width of the contacting surface 272 and/or the width of the contact surfaces 268*a*, 268*b* and the speed at which the pill is pushed out determines the time the momentary switch 290 remains in closed position.

As noted earlier, a photosensor or microswitch 300 may be incorporated in the package to provide a signal to the electronic device so that a visual or audible alert is given when the blister card insert is not replaced in the sleeve following dispensing of a pill. The sensor could be mounted on the circuit board 262 as shown, and could be a photosensor, microswitch, proximity switch, or even a set of contacts that make contact with a printed conductive trace in the package (not shown). A hole 301 is provided in the circuit board and paperboard to expose the sensor to the outside condition of the package. When the blister card insert is inside the sleeve the sensor would be shielded from the light (if a photosensor is used) or be pressed up against the inside of the sleeve (if a microswitch is used). Alternatively, the photosensor could be mounted facing the other way and "looking into" the inside of the blister card in the sleeve. While inside, this area would be dark, but when the insert is pulled out to dispense a pill, this area would no longer be dark. If a microswitch is used, the switch could also extend inwardly to detect if the blister card insert is folded over as it is when it is in the sleeve. When the blister card insert is opened, pressure would be taken off the switch. It would also be possible to connect the circuit board to printed traces on the blister card insert similarly to that used for the momentary switch circuit 290. These traces, however, could connect to a sensor somewhere else on the package or be exposed at one point so they can make connection to a conductor inside the package.

Alternate Embodiments of Sleeve and Insert

Alternate embodiments of the sleeve and insert, and especially the latch and retaining means, are depicted in FIGS. 38-47. Any of these forms may include the circuitry of FIGS. 31-37.

FIGS. 38A-D show a first variation, wherein the latching or locking feature can be made with either a folded over paperboard or a plastic part (indicated generically at 310 in these figures). If paperboard is used, an inside layer of board would be folded in such a manner as to create a step wedge. This layer would then be affixed to the inside surface of the sleeve with glue, or heat sealed if a substrate such as SealPak or SafePak is used (in applicant's commonly owned copending application Ser. No. 11/593,462, the disclosure of which is incorporated by reference in full herein). A substrate such as SafePak would be preferred since it has a tear resistant layer which would prevent a child from tearing open the package and defeating the child resistant features. As an alternative, the step wedge could be made out of a plastic piece which is affixed to the inside of the sleeve at the appropriate location. The folded blister card insert would have one panel longer than the other with the extreme end 312 folded over towards the inside of the blister card. A hole 311 (see FIG. 44D) would be cut into the main part of the panel in a location so that when the blister card is pushed into the sleeve the step wedge would lock into it. The folded tail on the blister card provides spring force so the edge of the hole cannot be pulled past the step wedge. In this design the folded tail provides spring force and also aids in preventing complete removal of the blister card and retaining it attached to the sleeve.

Figure 38A:
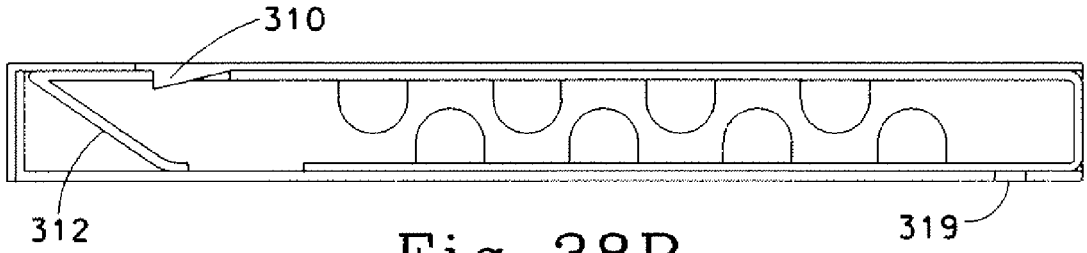
FIG. 38A is a side view in section of a first variation of latch and retaining means, showing the blister card insert fully inserted and latched in the sleeve.
Figure 38B:
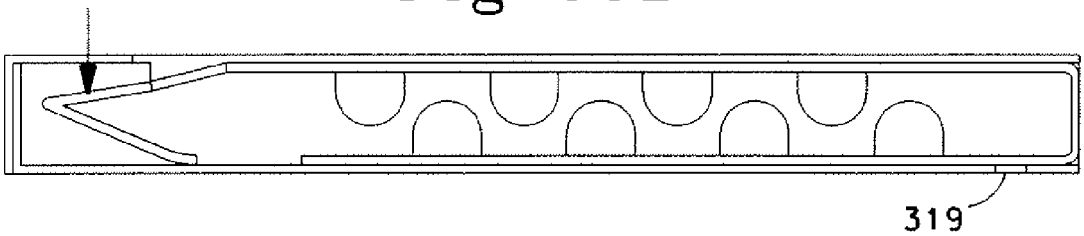
FIG. 38B is a view similar to FIG. 38A, on a reduced scale, showing the end of the blister card insert being depressed to release the latch.
Figure 38C:
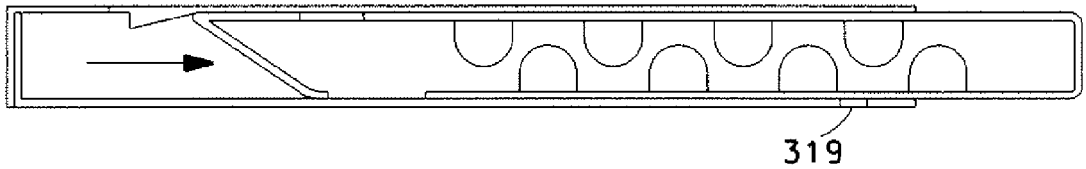
FIG. 38C is a view similar to FIG. 38B, showing the insert being withdrawn from the sleeve after the latch is released.
Figure 38D:
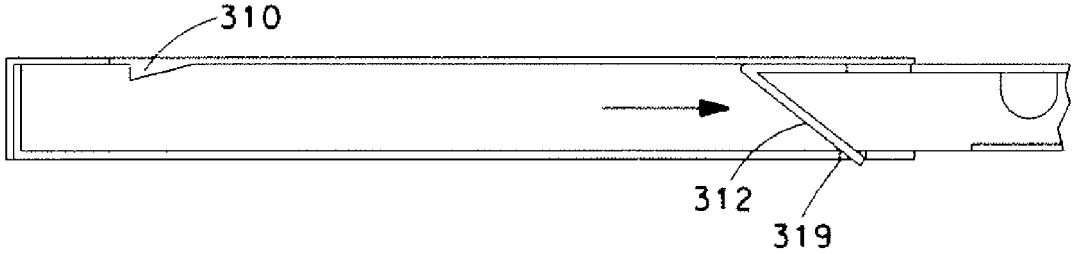
FIG. 38D is a view similar to FIG. 38C, showing the insert fully withdrawn from the sleeve and the retaining means engaged to prevent separation of the insert from the sleeve.
Figure 39A:
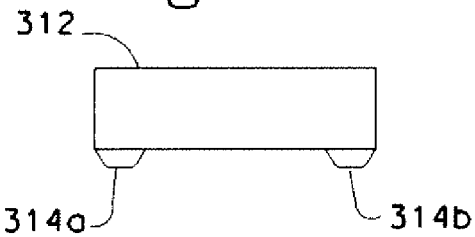
FIGS. 39A and 39B are end views of the insert, showing alternate forms of retaining tabs that may be provided on the end of the insert.
Figure 39B:
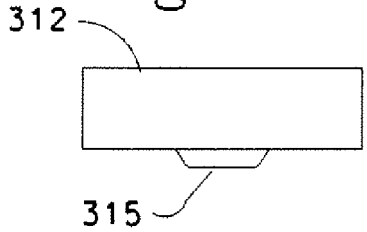

FIGS. 39A and 39B depict alternate forms of folded tail. In FIG. 39A the tail has two tabs 314*a* and 314*b* on the end of the folded end 312 at opposite sides thereof, and in FIG. 39B a central tab 315 is formed on the end of the tail. These tabs form one part of a retaining means, and one or more holes 319 in the bottom panel of the sleeve are positioned so that the tabs drop into the holes when the insert is withdrawn from the sleeve, as indicated in FIG. 38D, to prevent complete separation of the insert from the sleeve.

Figure 40A:
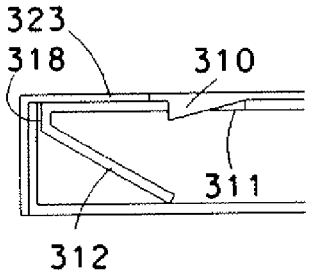
FIGS. 40A and 40B are fragmentary side views in section of a portion of the insert and sleeve, showing alternate folds on the end of the insert.
Figure 40B:
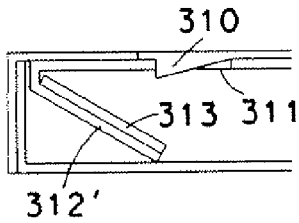
Figure 40C:
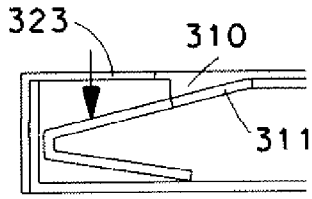
FIG. 40C is a view similar to FIGS. 40A and 40B, showing the end of the insert being depressed to release the latch.

Alternate tail shapes are shown in FIGS. 40A and 40B, wherein the panels are folded so that a nose or vertical panel 318 is formed at the end of the insert. Additionally, the folded end 312' in FIG. 40B has an extra folded panel 313. This extra material adds stiffness to the folded end and strengthens the spring-like action provided by the folded end. FIG. 40C depicts the end of the insert being depressed to release the latch from the opening 311.

Figure 41A:
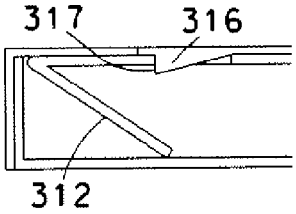
FIG. 41A is a fragmentary side view in section of a portion of the insert and sleeve, showing a first form of step wedge latch that is devoid of a lip.
Figure 41B:
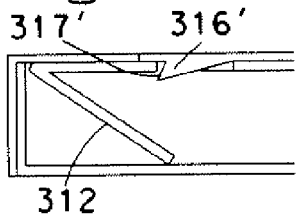
FIG. 41B is a fragmentary side view in section similar to FIG. 41A, showing a second form of step wedge latch that has a lip.

FIGS. 41A and 41B show alternate forms of step wedge latch. In FIG. 41A the latch 316 has a planar end 317 oriented perpendicular to the plane of the insert, and in FIG. 41B the end 317' of the latch 316' is undercut, i.e., tapers rearwardly so the edge of the hole cannot be pulled past unless it is pushed forward a bit before it is pushed down to clear the step wedge.

Figure 42A:
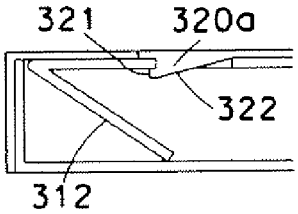
FIGS. 42A and 42B are fragmentary side views in section showing further forms of step wedge latches, wherein the step wedge latch comprises a piece of plastic or similar material affixed to the inside of the sleeve, both forms having a lip but having differently shaped sloping surfaces.
Figure 42B:
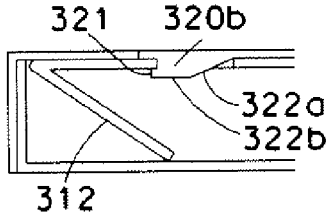
Figure 43A:
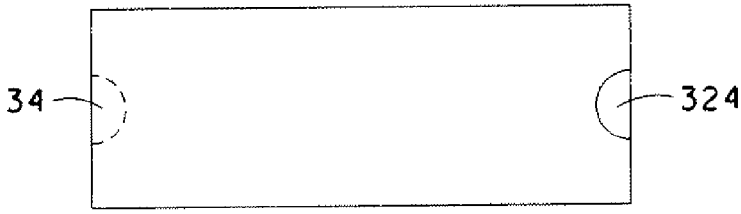
FIG. 43A is a plan view of an alternate form of sleeve according to the invention, wherein a tear out portion is also provided on the open end of the sleeve to facilitate grasping and pulling of the insert.
Figure 43B:
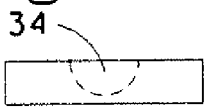
FIGS. 43B and 43C are end and side elevational views, respectively, of the sleeve of FIG. 43A.
Figure 43C:
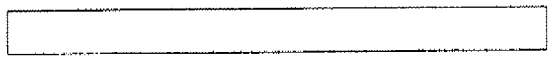
Figure 44A:
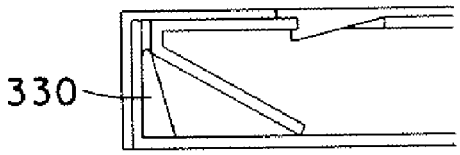
FIGS. 44A, 44B and 44C are fragmentary side views in section of a portion of the sleeve and insert according to another form of the invention, wherein spring-like devices are in the end of the sleeve to bias the insert rearwardly, and depicting how, to release the latch, the insert is first pushed forwardly into the sleeve against the spring-like devices, and the end of the insert is then depressed to release the latch.
Figure 44B:
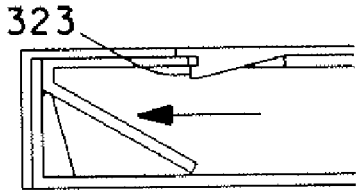
Figure 44C:
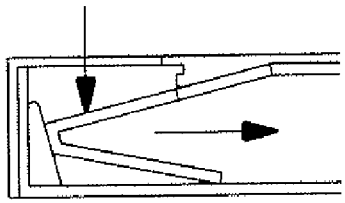
Figure 44D:
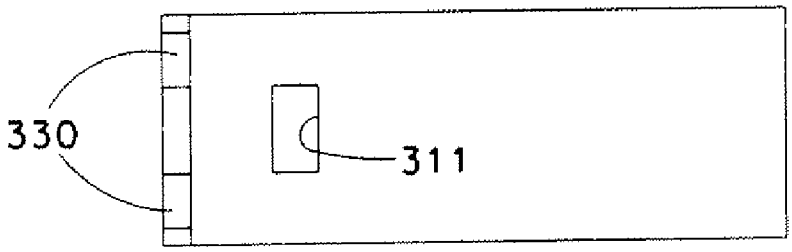
FIG. 44D is a top view in section of the package of FIGS. 44A-C, showing the positions of the spring-like devices in the sleeve, and the hole in the insert for cooperation with the step wedge latch.

FIGS. 42A and 42B depict step wedge latches 320*a* and 320*b*, respectively, made of a plastic material and both having lips 321 formed thereon so the edge of the hole cannot be pulled past unless it is pushed forward a bit before it is pushed down to clear the step wedge. In FIG. 42A the backside 322 of the wedge comprises a straight ramp, whereas in FIG. 42B the backside comprises a first, inclined ramp portion 322*a* and a second, horizontal portion 322*b*. The final shape of the piece may not even appear to look like a "wedge".

The release mechanism for releasing the latch in these variations basically comprises pushing down on the end of the top blister card panel, just before the folded tail 312, 312'. This causes the edge of the hole to clear the step wedge and then the folded blister card can be pulled outward through the open end of the sleeve. There are several ways to accomplish this. One way is to have a simple perforated die-cut at the end of the package forming a tear out panel 34 (see the description of the earlier embodiments) which when pulled away would leave an access hole 323. The user would push down on the exposed end of the blister card, causing the edge of the hole on the card to clear the step wedge. While still depressing the end of the card the user would grasp the other end (spine) of the folded blister card through a cutout area 324 (top & bottom) and pull it outward. The cutout areas for grasping the blister card could also be located on the sides of the sleeve instead of the top and bottom. It is also possible to eliminate the cutout areas and push the blister card rearward through the open end of the sleeve with the finger positioned through the access 323 after the card has been pushed down so the hole can pass clear of the step wedge. In this case the folded tail design shown in FIGS. 40A-40C may be the more appropriate design.

If the step wedge is made in such a way as to have a lip 321, the release action could require the user to push the folded blister card inward from the open end of the sleeve before the other end is pushed down to clear the step wedge, as in the embodiment first described herein.

It is also possible to have a spring-like device 330 (actual spring, foam rubber, flexible plastic . . . etc.) inside the sleeve at the closed end to keep the blister card pushed toward the open end (see FIGS. 44A-D). This would keep the latch engaged against the step wedge and if it has a lip, would assure that the user is required to push the blister card inward first. It also would automatically push the blister card out from the sleeve after it is cleared of the step wedge. The spring-like device could also be attached to the folded tail of the blister card instead of the interior of the sleeve.

Figure 45A:
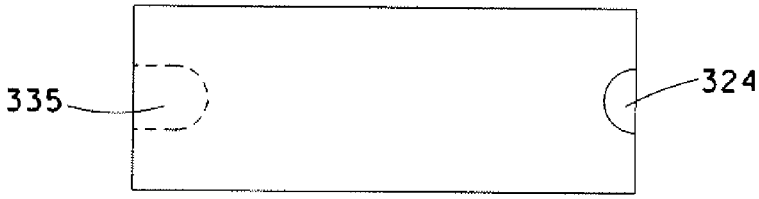
FIGS. 45A and 45B are plan and end elevational views, respectively, of a further form of package according to the invention, wherein a depressible tab is provided in lieu of the tear out panel of previous forms for depressing the end of the insert to release the latch.
Figure 45B:
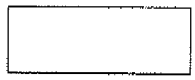
Figure 45C:
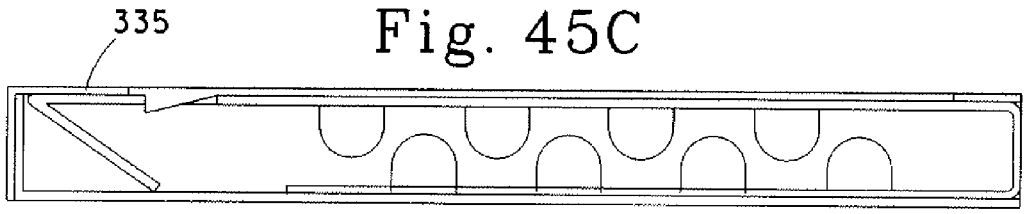
FIG. 45C is a side view in section of the package of FIGS. 45A and 45B.

As shown in FIGS. 45A-C, instead of having a perforated cutout or even a full cut area where the user's finger would press down on the folded tail, a die-cut tab 335 could be made in the top of the sleeve. The tab would not be removed from the sleeve, but could be deflected downwardly. Thus, the user would push down on the tab which would in turn push down on the folded tail to release the latch. This tab could face forward as show in FIG. 45A or rearward.

As with the earlier embodiments described herein, when the blister card insert is withdrawn from the sleeve it is desirable to keep it attached to the sleeve in some manner so the parts do not get lost from each other. Also, the user is more likely to re-close the package, thus retaining its child resistance properties. In the embodiments described immediately above, appropriately sized hole(s) or cutout(s) 326 are provided in the bottom panel of the sleeve near its open end. Since the folded tail 312 would want to spring open inside the sleeve, it would then be inclined to drop into the hole 326 when it is attempted to be pulled over it. The tail 312 would then be wedged between the top and bottom panels of the sleeve, preventing the blister card insert from being completely removed and separated from the sleeve. The tail and holes could be of various designs to accomplish this, such as, e.g., the tabs 314*a*, 314*b* and 315 shown in FIGS. 39A and 39B.

Figure 46:
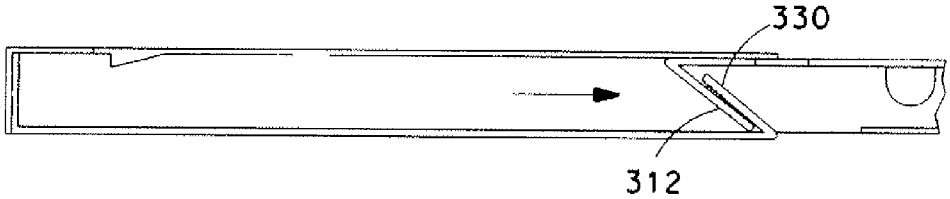
FIG. 46 is a side view in section of another form of the invention, wherein a reverse-folded flap on the open end of the sleeve cooperates with the insert to retain it in the sleeve, as in the first embodiments disclosed herein.

An alternate method could comprise an inwardly folded end flap 330 on the bottom of the sleeve at its open end, as in the earlier embodiments described herein. This flap could be a simple single fold or double folded to make it twice as thick. As the insert is pulled outward, the folded tail 312 on the insert would then slide under the end flap and catch on it as shown in FIG. 46. A double folded flap would be preferred since it would strengthen the flap and also provide a more rounded edge so the folded tail would more easily slide under it.

Figure 47A:
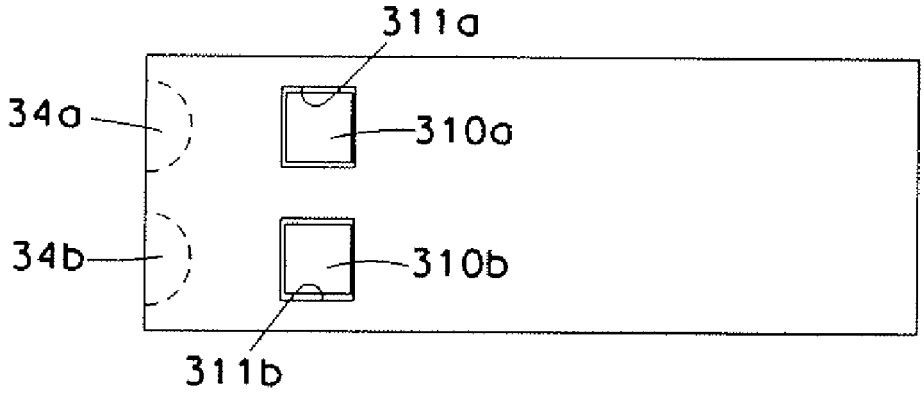
FIG. 47A is a somewhat schematic top plan view of an alternate package according to the invention, wherein a pair of tear out panels are provided in the end of the sleeve to provide access for the fingers to depress the end of the insert to release the latch, and showing the step wedge latches equidistantly spaced from the sides and ends of the sleeve.
Figure 47B:
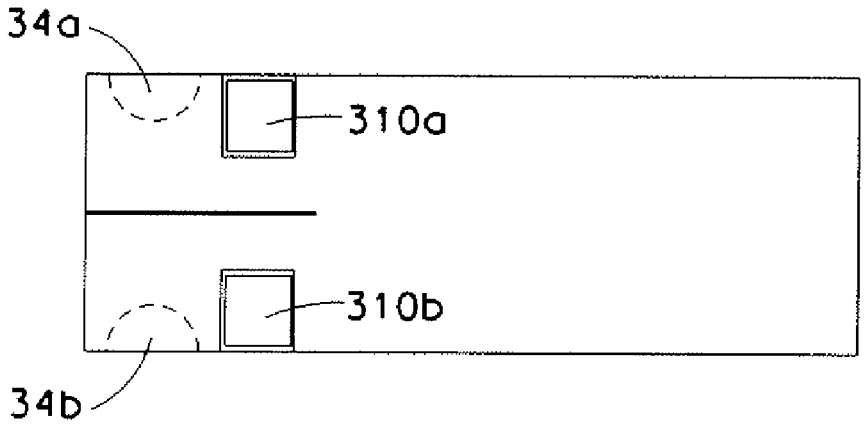
FIG. 47B is a view similar to FIG. 47A, wherein the step wedge latches are moved to the side edges of the sleeve.
Figure 47C:
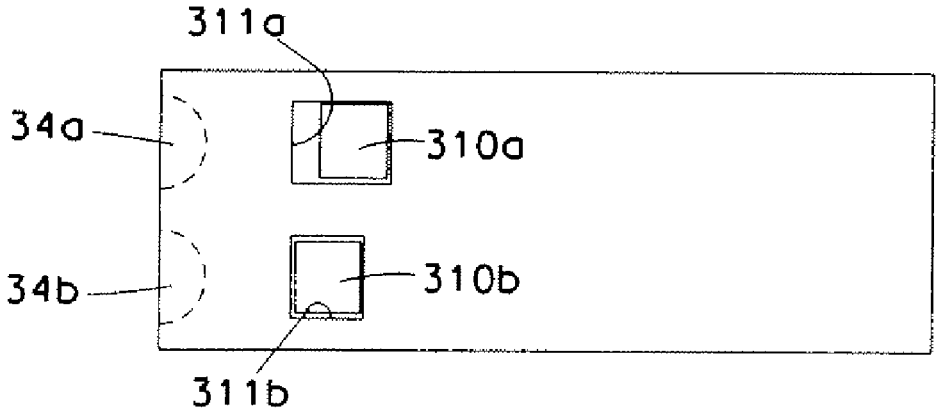
FIG. 47C is a view similar to FIG. 47A, wherein one of the step wedge latches is longitudinally offset relative to the other.

As depicted in FIGS. 47A-C, it is also possible to use two step wedges 310*a*, 310*b* to provide a double release mechanism. These could be spaced equidistantly from the side edges of the sleeve (FIG. 47A), or located close to the outside edges (FIG. 47B), or longitudinally offset (FIG. 47C). Holes 311*a*, 311*b* in the blister card insert would be appropriately located to lock into the step wedges. Two access holes or push tabs (indicated generically by 34*a*, 34*b*) would also be used. If positioned close enough to the edge of sleeve, pressure on the blister card would need to be applied through both access holes to allow the holes in the blister card to clear the step wedges. This is because if only one side was pushed the blister card would twist and only one hole would be pushed low enough to clear the step wedge. This effect would be increased if the center edge of the folded tail was longer than the side edges. (see FIG. 39B). The tail of the blister card could instead be slit down the center, so in essence there would be two tails that act independently of each other (not shown).

When the step wedges, and correspondingly the holes in the blister card insert, are longitudinally offset as shown in FIG. 47C, one hole must be released from the step wedge first and then the other. In this case the hole in the blister card for the second release would be elongated so the card can move forward after the first hole is released. After this, the edge of the second hole would lock against the second step wedge and require the user to press down on that side of the blister card to enable its release. A variety of combinations could be made with this system, including the use of access holes versus push tabs.

Other design possibilities are, for example, a catch or latch tab on the latch panel can be made by either automatically pre-bending it during the insertion operation or embossing the catch during the die-cutting. A change in the position of the nicks and additional nicks could help hold the pill door flat. The pills could also be arranged at an angle so the edge of the pill door and the edge of the retaining tab are not parallel. Another alternative concept would be to form the plastic pill blister of basically the same shape as the insert. This would be accomplished in the vacuum forming and die-cutting process and eliminate the need for paperboard inner components and the heat sealing that is required to join them together. Depending on the intended usage, the heat sealing may be a time consuming step and also may have detrimental effects to the medication within the blister cavities. In addition, to stiffen the structure, small linear blister cavities can be formed as is known in the industry. The scores on which the card and Z-folded tail will fold can be similarly formed or by a scoring die or small cuts in the plastic during the die-cutting. It is also possible to substitute a simple cut line for the lock catch instead of the full cutout. This would eliminate the need for the cutout portion to be removed during the converting.

The retaining tab on the outer package can be relocated to the opposite side of the package so it would engage on the lock catch of the inner card instead of the Z-folded tail. This would eliminate the problem with the flap catching on the pill cavities. In addition this would also allow the package to be made with only one panel instead of a folded over design. A die-cut tab can be mad in the top of the box. This tab could be oriented up to 180 degrees from what was originally shown and could also be formed from a "Tuck Flap" tab from an end panel. The "Tuck Flap" is similar to the standard end flap closure on a typical package. It can be of varying lengths but must be long enough to press the inner Z-fold tail on the inner blister card. Depressing this "Tuck Flap" can be done directly though a hole in the outer box, as illustrated. Alternatively a push tab on the outer package can be pressed against the "Tuck Flap".

Although particular embodiments of the invention are illustrated and described in detail herein, it is to be understood that various changes and modifications may be made to the invention without departing from the spirit and intent of the invention as defined by the scope of the appended claims.

What is claimed is:

1. A child-resistant package, comprising:

a sleeve having top and bottom walls, opposite side walls, a closed end, and an open end;

a blister card insert movable into and out of the sleeve through the open end;

a first latch element on the insert and a second latch element on the sleeve, the first and second latch elements being interengageable when the insert is fully inserted in the sleeve to latch the insert against withdrawal from the sleeve;

a biasing member on the insert configured to be in contact with the top and bottom walls of the sleeve, urging the first latch element into engagement with the second latch element, the biasing member also forming a first portion of a retaining means to prevent complete withdrawal of the insert from the sleeve; and a second portion of the retaining means being formed on the sleeve for cooperation with the first portion to retain the insert against complete withdrawal from the sleeve.

2. The child-resistant package of claim 1, wherein the second latch element includes a latch panel foldably joined to the top wall.

3. The child-resistant package of claim 2, wherein the second latch element further includes a narrow latch tab integrally attached to the latch panel.

4. The child-resistant package of claim 1, wherein the second portion of the retaining means is defined by an extension panel foldably joined to the sleeve.

5. The child-resistant package of claim 4, wherein the extension panel is integrally attached to the bottom wall of the sleeve.

6. The child-resistant package of claim 1, wherein the sleeve includes a finger access opening that permits a user to press down on the biasing member to disengage the first and second latch elements from one another.

7. The child-resistant package of claim 1, wherein the blister card insert is defined by first and second blister card units that are integrally attached to one another by a hinge panel.

8. The child-resistant package of claim 7, wherein each of the first and second blister card units comprises a plurality of raised blister cavities containing pills or other objects in the blisters.

9. The child-resistant package of claim 7, wherein the first blister card unit includes an opening therethrough wherein one edge of the opening protrudes into the opening to define the first latch element.

10. The child-resistant package of claim 9, wherein the first latch element comprises a latch tab.

11. The child-resistant package of claim 1, wherein the biasing member is defined by two foldable panels folded into a Z-shaped configuration.

12. The child-resistant package of claim 1, wherein the biasing member is integrally formed in the first blister card unit.

13. A child-resistant package, comprising:

a sleeve having top and bottom walls, opposite side walls, a closed end, and an open end;

a blister card insert movable into and out of the sleeve through the open end;

a first latch element on the insert and a second latch element on the sleeve, the first and second latch elements being interengageable when the insert is fully inserted in the sleeve to latch the insert against withdrawal from the sleeve;

biasing means operatively connected with the insert to urge the insert in a direction toward the open end of the sleeve and to urge the first latch element into engagement with the second latch element; and release means operable to disengage the first and second latch elements to permit withdrawal of the insert from the sleeve, the release means being ineffective to disengage the first and second latch elements until the insert is moved farther into the sleeve against the biasing means.

14. The child-resistant package of claim 13, wherein the first latch element is defined by a combination of an opening and a latch tab formed on the insert.

15. The child-resistant package of claim 13, the second latch element is defined by a narrow latch tab formed on the sleeve.

16. The child-resistant package of claim 15, wherein the latch tab on the second latch element is a catch that extends into the opening and engages with the latch tab on the insert.

17. The child-resistant package of claim 13, wherein the biasing means is defined by two foldable panels folded into a Z-shaped configuration that engages behind an inwardly folded extension panel on the sleeve to retain the blister card insert in the sleeve and prevent complete separation of the insert from the sleeve.

18. The child-resistant package of claim 13, wherein the biasing means comprises a separate spring-like device in the end of the sleeve for acting against an adjacent end of the insert to urge it toward the open end of the sleeve.

19. The child-resistant package of claim 13 further comprising a circuitry incorporated with the blister card insert to provide an alert when the package is left open and to monitor the dispensing of pills or other objects from the package.

20. A blank for making a sleeve of a child-resistant package that has a sleeve with top and bottom walls, opposite side walls, a closed end, and an open end, and a blister card insert movable into and out of the sleeve through the open end, the blank comprising:

two major panels disposed in spaced side-by-side relationship and that form the top and bottom walls, respectively, of a sleeve erected from the blank, a first minor panel connected between adjacent side edges of the major panels and that forms one sidewall of a sleeve erected from the blank, and second and third minor panels on opposite outer side edges of the respective major panels and that together form a second sidewall of a sleeve erected from the blank;

a first flap foldably joined to a first end of one of the major panels, and a second flap foldably joined to an end of the other major panel that is adjacent the first flap, the first and second flaps being overlapped and glued together in a sleeve erected from the blank to form one end wall;

a latch panel foldably joined to a second end of the one major panel opposite the first end, the latch panel having a free end and a narrow latch tab projecting from the free end;

an extension panel joined to the end of the other major panel opposite the end to which the second flap is attached; and a first line of perforations in a midportion of the first flap and in an adjacent portion of the one major panel, the first line of perforations defining a first tear-out panel, and a second line of perforations in a midportion of the second flap, the second line of perforations defining a second tear-out panel, the first and second tear-out panels overlying one another and being removed together to form a finger access opening in a sleeve erected from the blank.

21. A blank for making an insert of a child-resistant package that has a sleeve with top and bottom walls, opposite side walls, a closed end, and an open end, and a blister card insert movable into and out of the sleeve through the open end, the blank comprising:

a paperboard substrate comprising a first panel with a plurality of openings therethrough for receiving raised blister cavities of a blister pack when a blister pack is attached to the first panel, a second panel foldably connected to one side edge of the first panel, a plurality of score lines in the second panel defining punch-out areas that are in aligned registry with the openings in the first panel when the first and second panels are folded into overlying relationship with one another;

a first end of each of the first and second panels being elongated, with spaced apart parallel fold creases extending transversely across the elongated ends, defining two foldable panels on the elongated ends of each of the first and second panels, the foldable panels defining a biasing member and retaining means in a package erected from the blank;

openings in the first and second panels, respectively, in positions to be in aligned registry with one another when the panels are folded into overlying relationship with one another, one edge of each opening shaped to define a latch tab protruding into the opening from a side thereof, the latch tab comprising a first latch element for cooperation with a second latch element on a sleeve in a package erected from the blank; and a third panel foldably connected by a hinge panel to a second end of the first panel opposite the first end, and a fourth panel foldably connected to a side edge of the third panel and also foldably connected by a hinge panel to a second end of the second panel, the third panel being constructed substantially identically to the first panel, and the fourth panel being constructed substantially identically to the second panel, except that the third and fourth panels are shorter in length than the first and second panels.

* * * * *